US011662155B2

(12) United States Patent
Cheng

(10) Patent No.: US 11,662,155 B2
(45) **Date of Patent: *May 30, 2023**

(54) PULSE LOOP HEAT EXCHANGER AND MANUFACTURING METHOD OF THE SAME

(71) Applicant: COOLER MASTER CO., LTD., New Taipei (TW)

(72) Inventor: Jen-chih Cheng, New Taipei (TW)

(73) Assignee: COOLER MASTER CO., LTD., New Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 17/649,626

(22) Filed: Feb. 1, 2022

(65) Prior Publication Data

US 2022/0155024 A1 May 19, 2022

Related U.S. Application Data

(63) Continuation of application No. 16/936,207, filed on Jul. 22, 2020, now Pat. No. 11,255,610.

(60) Provisional application No. 62/964,130, filed on Jan. 22, 2020.

(51) Int. Cl.
*F28D 15/00* (2006.01)
*F28D 15/02* (2006.01)

(52) U.S. Cl.
CPC ..... *F28D 15/0266* (2013.01)

(58) Field of Classification Search
CPC ..... F28D 15/0266; F28D 15/0275; F28D 15/0283; B23P 2700/09
See application file for complete search history.

(56) References Cited

U.S. PATENT DOCUMENTS

| | | | |
|---|---|---|---|
| 6,810,947 | B2 | 11/2004 | Tanaka et al. |
| 2003/0070792 | A1 | 4/2003 | Tanaka et al. |
| 2003/0079864 | A1 | 5/2003 | Ohara |
| 2005/0211427 | A1 | 9/2005 | Kenny et al. |
| 2006/0042825 | A1 | 3/2006 | Lu et al. |
| 2010/0012300 | A1 | 1/2010 | Moon et al. |
| 2011/0272121 | A1 | 11/2011 | Suzuki et al. |
| 2012/0018130 | A1 | 1/2012 | Chang et al. |
| 2013/0039819 | A1 | 2/2013 | Chen |
| 2018/0356161 | A1 | 12/2018 | Rousseau et al. |

*Primary Examiner* — Travis Ruby
(74) *Attorney, Agent, or Firm* — Dickinson Wright PLLC

(57) ABSTRACT

A pulse loop heat exchanger, under vacuum, having a working fluid therein, comprising a heat exchanger body, a first continuity plate, and a second continuity plate is provided. The heat exchanger body, first continuity plate comprises a plurality of channels and grooves on different elevated plane levels, respectfully. The different elevated plane levels result in increased output pressure gain in downward working fluid flow portions of the grooves, boosting thermo-fluidic transport oscillation driving forces throughout the heat exchanger. In addition to providing for fluid transport and boosting oscillation driving forces, the third elevated continuity channel also provides an internal reservoir. The heat exchanger is formed by an aluminum extrusion and stamping process and comprises three main steps, a providing step, a closing and welding step, and an insertion, vacuuming and closing step.

15 Claims, 15 Drawing Sheets

PULSE LOOP HEAT EXCHANGER AND MANUFACTURING METHOD OF THE SAME

CROSS-REFERENCE TO RELATED APPLICATION

This application is a continuation of U.S. patent application Ser. No. 16/936,207, filed Jul. 22, 2020, which claims priority to U.S. Provisional Patent Application No. 62/964,130, filed on Jan. 22, 2020, including the specification, drawings and abstract, the entire disclosure of which is incorporated herein by reference.

TECHNICAL FIELD

Example embodiments relate generally to the field of heat transfer and, more particularly, to pulse loop heat exchangers and manufacturing methods of the same.

BACKGROUND

During operation of electronic systems, the heat generated by processors must be dissipated quickly and efficiently to keep operating temperature within manufacturer recommended ranges, under, at times, challenging operating conditions. As these electronic systems increase in functionality and applicability so does operating speed of the processors used therein; with an increase in operating speeds and an increase in the number of processors employed, power requirements of the electronic systems also increase, which in turn, increases cooling requirements.

Several techniques have been developed for extracting heat from processors in electronic systems. One such technique is an air-cooling system, wherein a heat exchanger is in thermal contact with a processor, transporting heat away from the processor, and then air flowing over the heat exchanger removes heat therefrom. One type of heat exchanger is a pulse loop heat exchanger. In general, a pulse loop heat exchanger is a system comprising a multitude of channels, at least some of which are of capillary dimension. The system may be a closed- or open-looped system. In a closed-looped system, pulse loop heat exchangers are vacuum containers that carry heat from a heat source by evaporation of a working fluid which is spread by a vapor flow filling the vacuum. The vapor flow eventually condenses over cooler surfaces, and, as a result, the heat is distributed from an evaporation surface (heat source interface) to a condensation surface (larger cooling surface area). Flow instabilities occur inside of the pulse loop heat exchangers due to the heat input at the heat source end and heat output at the cooling surface end. Thereafter, condensed fluid flows back to near the evaporation surface.

The thermal performance of pulse loop heat exchangers is dependent on the effectiveness of the heat exchangers to dissipate heat via the phase change (liquid-vapor-liquid) mechanism through its channels. An important aspect to achieving desired thermal performance is the effectiveness of the manufacturing method to be simplified, increasing consistency in the manufacturing process. Another important aspect to achieving desired thermal performance is the effectiveness of the manufacturing method to close and seal the heat exchangers to avert poor leak tightness and poor body strength thereabout; which can lead to the loss of working fluid and dry-out, without increasing complexity of the manufacturing method. Yet another important aspect to achieving desired thermal performance is the effectiveness of the manufacturing method to promote fluid and vapor flow without increasing complexity of the manufacturing method.

BRIEF DESCRIPTION OF THE DRAWINGS

Unless specified otherwise, the accompanying drawings illustrate aspects of the innovative subject matter described herein. Referring to the drawings, wherein like reference numerals indicate similar parts throughout the several views, several examples of pulse loop heat exchangers incorporating aspects of the presently disclosed principles are illustrated by way of example, and not by way of limitation.

DETAILED DESCRIPTION

The following describes various principles related to heat exchanger systems and methods by way of reference to specific examples of heat exchanger systems and methods, including specific arrangements and examples of metal plates, channels and grooves embodying innovative concepts. More particularly, but not exclusively, such innovative principles are described in relation to selected examples of heat exchanger systems and methods and well-known functions or constructions are not described in detail for purposes of succinctness and clarity. Nonetheless, one or more of the disclosed principles can be incorporated in various other embodiments of heat exchanger systems and methods to achieve any of a variety of desired outcomes, characteristics, and/or performance criteria without departing from the scope and spirit of the invention, as will readily be appreciated by those of ordinary skill in the art.

Thus, heat exchanger systems and methods having attributes that are different from those specific examples discussed herein can embody one or more of the innovative principles, and can be used in applications not described herein in detail. Accordingly, embodiments of heat exchanger systems and methods not described herein in detail also fall within the scope of this disclosure, as will be appreciated by those of ordinary skill in the relevant art following a review of this disclosure.

Example embodiments as disclosed herein are directed to pulse loop heat exchangers, under vacuum, and having a working fluid therein, and manufacturing methods of the same. In an exemplary embodiment, a pulse loop heat exchanger comprises a heat exchanger body, a first continuity plate, and a second continuity plate. As will be described in further detail throughout this specification, the heat exchanger body and first continuity plate and second continuity plate comprise a plurality of channels and grooves on different elevated plane levels, respectfully. The different elevated plane levels result in increased output pressure gain in downward working fluid flow portions of the grooves, boosting thermo-fluidic transport oscillation driving forces throughout the heat exchanger. The second continuity plate comprises a second continuity plate attachment surface having a third elevated continuity channel. In addition to providing for fluid transport and boosting oscillation driving forces, the third elevated continuity channel also provides an internal reservoir. The heat exchanger is formed by an aluminum extrusion and stamping process and comprises three main Steps, a providing Step, a closing and welding Step, and an insertion, vacuuming and closing Step. The material is preferably aluminum, or an aluminum-alloy or the like, although other suitable materials may be substituted as will be appreciated by those of ordinary skill in the art.

Figure 1A:
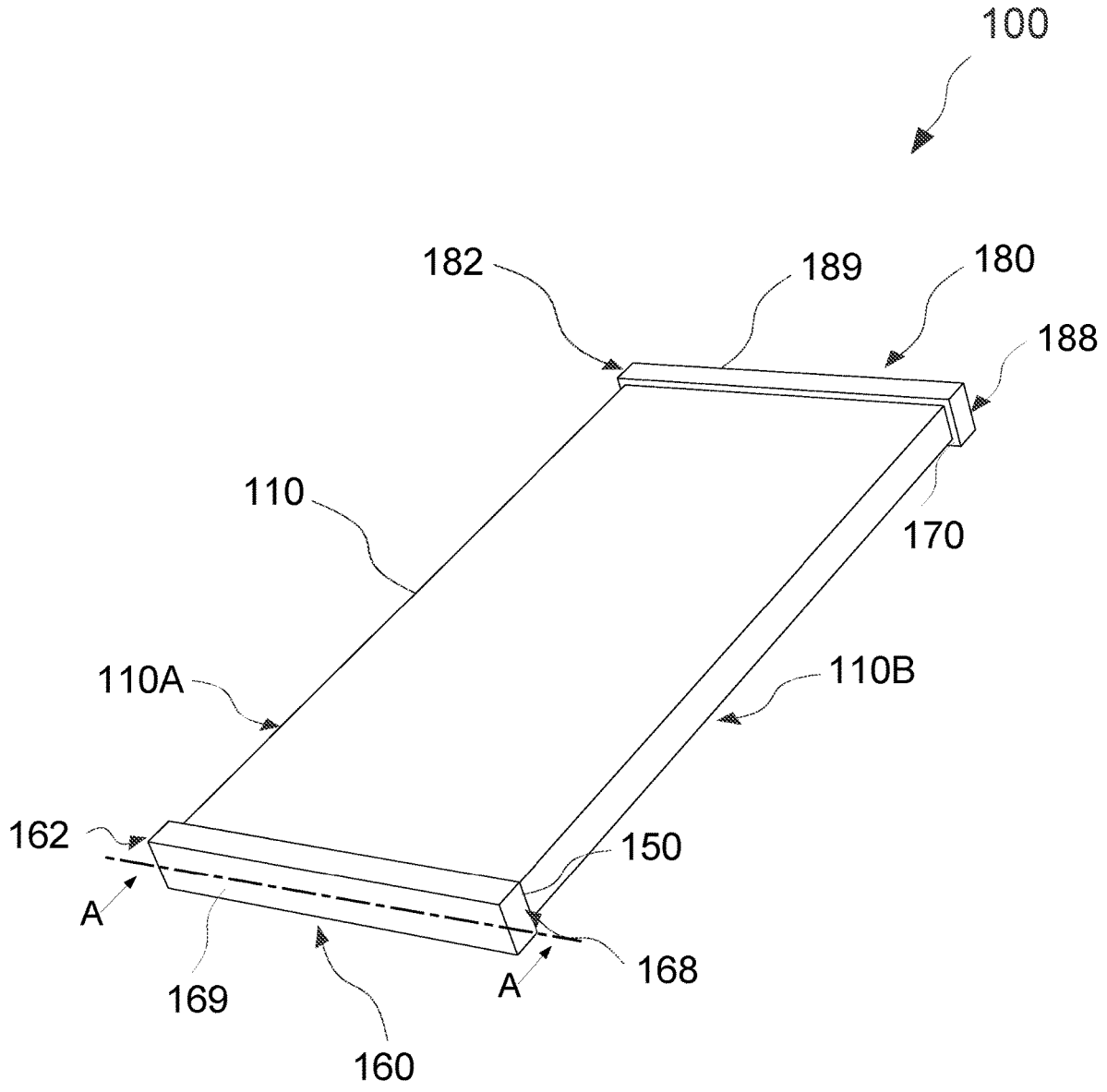
FIG. 1A is a schematic perspective view of a pulse loop heat exchanger, according to an example embodiment.
Figure 1B:
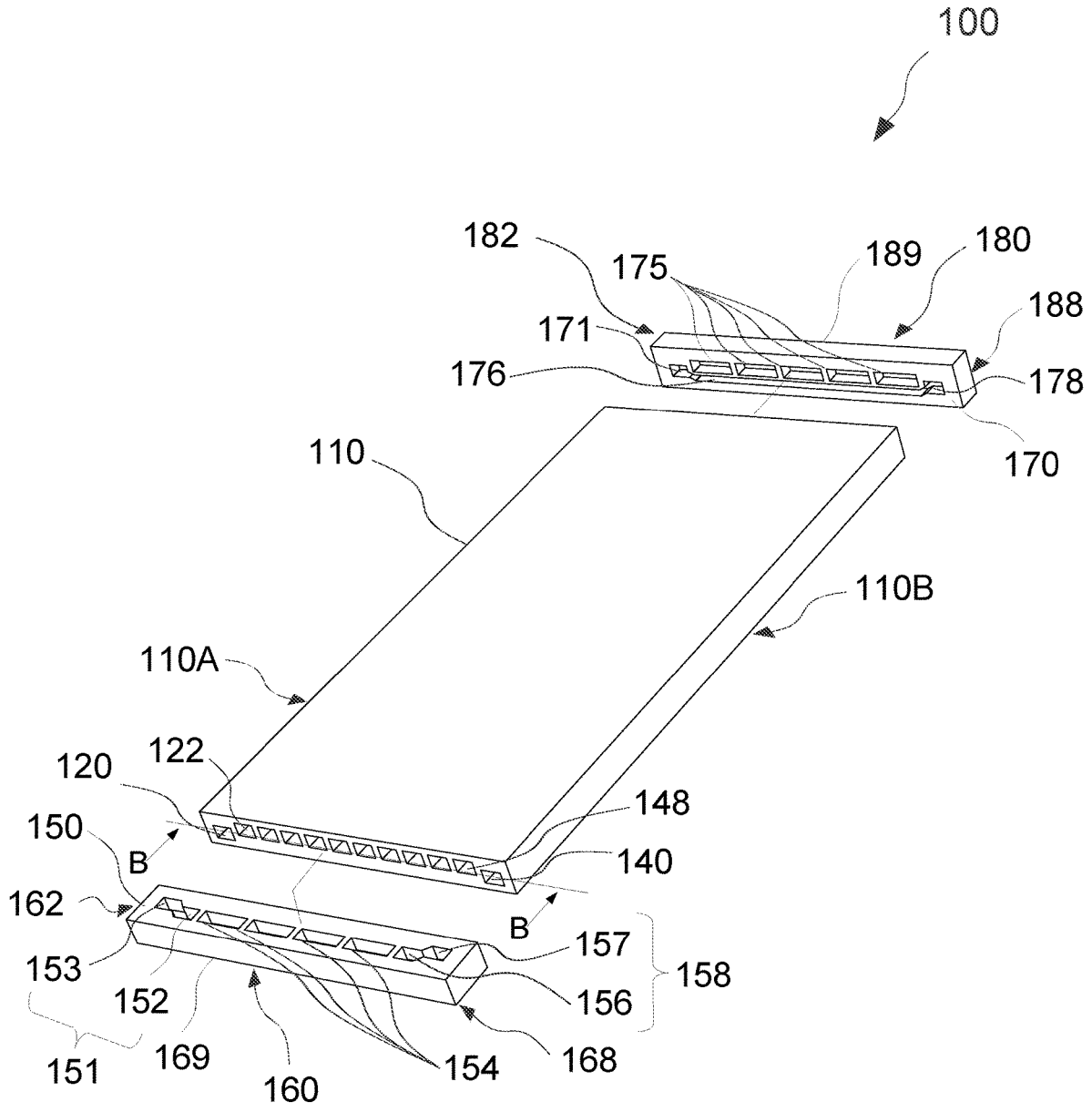
FIG. 1B is an exploded view of the pulse loop heat exchanger of FIG. 1A, according to an example embodiment.
Figure 1C:
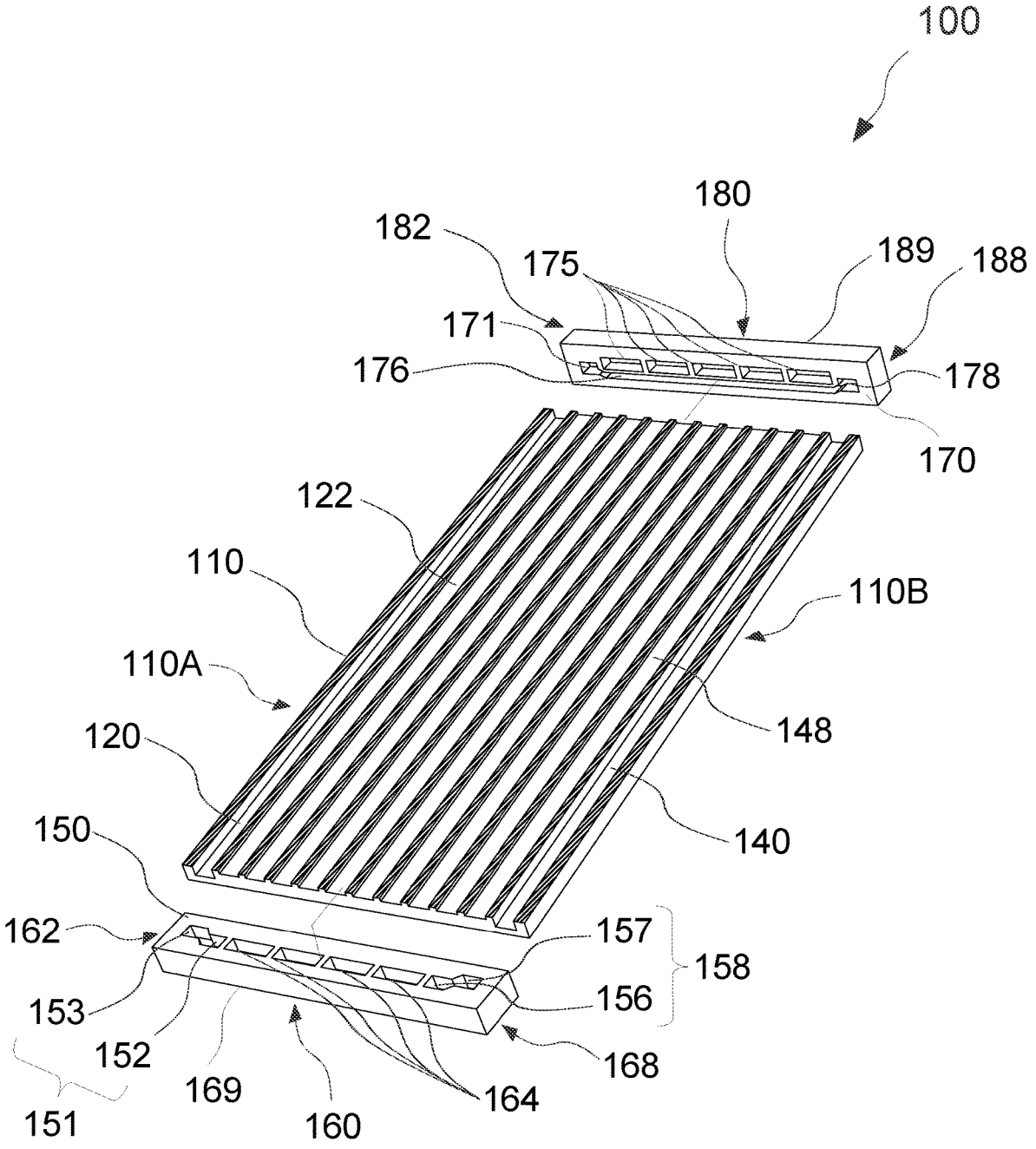
FIG. 1C is a schematic cross-sectional view of the heat exchanger body of the pulse loop heat exchanger of FIG. 1A along line B-B in FIG. 1B, according to an example embodiment.

FIG. 1A is a schematic perspective view of a pulse loop heat exchanger, according to an exemplary embodiment. FIG. 1B is an exploded view of the pulse loop heat exchanger of FIG. 1A, according to an exemplary embodiment. FIG. 1C is a schematic cross-sectional view of the heat exchanger body of the pulse loop heat exchanger of FIG. 1A along line B-B in FIG. 1B, according to an exemplary embodiment. Referring to FIGS. 1A to 1C, a pulse loop heat exchanger 100 is provided, comprising a first continuity plate 160, a second continuity plate 180 and a heat exchanger body 110. The heat exchanger body 110 comprises a near body end 110A having a first elevated near-end channel 120 and at least one second elevated near-end channel 122 and a far body end 110B having a first elevated far-end channel 140 and at least one second elevated far-end channel 148. The first elevated near-end channel 120 is disposed substantially parallel and nearest to an edge of the first body end 110A and the at least one second near-end elevated channel 122 is disposed substantially parallel and sequentially next to the first elevated near-end channel 120. The first elevated far-end channel 140 is disposed substantially parallel and nearest to an edge of the second body end 1108 and the at least one second elevated far-end channel 148 is disposed substantially parallel and sequentially next to the first elevated far-end channel 140. The first elevated near-end channel 120 is on a same plane (a first plane) as the first elevated far-end channel 140 and the at least one second near-end elevated channel 122 is on a same plane as the at least one second far-end elevated channel 140 (a second plane). The elevation of the first plane is different from that of the second plane. The number of the at least one second elevated near-end channel 122 and the at least one second elevated far-end channel 148 is the same.

In an exemplary embodiment, the first continuity plate 160 comprises a continuity plate outer surface 169, a first continuity plate attachment surface 150, a first continuity plate end 162, and a second continuity plate end 168. The first continuity plate attachment surface 150 comprises a near-end continuity groove 151 having a first elevated near-end continuity groove 153 and a second elevated near-end continuity groove 152, a far-end continuity groove 158 having a first elevated far-end continuity groove 157 and a second elevated far-end continuity groove 156. In some embodiments, the first continuity plate attachment surface 150 further comprises at least one second elevated continuity groove 164. The first elevated near-end continuity groove 153 is disposed parallel and nearest to an edge of the first continuity plate end 162 and the second elevated near-end continuity groove 152 is disposed sequentially next to the first elevated near-end continuity groove 153 and is in communication therewith. The first elevated far-end continuity groove 157 is disposed parallel and nearest to an edge of the second continuity plate end 168 and the second elevated far-end continuity groove 156 is disposed sequentially next to the first elevated far-end continuity groove 156 and is in communication therewith. In some embodiments, the at least one second elevated continuity groove 164 is disposed between the second elevated near-end continuity groove 152 and the second elevated far-end continuity groove 156. The first elevated near-end continuity groove 153 is on a same plane (first plane) as the first elevated far-end continuity groove 157 and the second near-end elevated continuity groove 152 is on a same plane as the second far-end elevated continuity groove 156 (second plane). The first elevated near-end continuity groove 153 corresponds and communicates with the disposition and dimensions of the first elevated near-end channel 120. The first elevated far-end continuity groove 157 corresponds and communicates with the disposition and dimensions of the first elevated far-end channel 140. The second near-end elevated continuity groove 152 corresponds and communicates with the disposition and dimensions of the at least one second elevated near-end channel 122. The second far-end elevated continuity groove 156 corresponds and communicates with the disposition and dimensions of the at least one second elevated far-end channel 148. In some embodiments, the at least one second elevated continuity groove 164 is on a same plane as the second near-end elevated continuity groove 152 and the second far-end elevated continuity groove 156 (the second plane). In some embodiments, the at least one second elevated continuity groove 164 corresponds and communicates with the disposition and dimensions of a second elevated near-end channel 122 and a at least one second elevated far-end channel 148. The elevation of the first plane is different from that of the second plane. The number of the second elevated near-end continuity groove 152 and the second elevated far-end continuity groove 156, respectively, is the same. In some embodiments, the number of the at least one second elevated continuity groove 164 is one, two, three, four or greater. As an example and not to be limiting, if the number of the second elevated near-end channel 122 and at least one second elevated far-end channel 148 is three, respectively, then two second elevated continuity grooves 164 would correspond and communicate with the disposition and dimensions of a second and third elevated near-end channel 122 and a second and third elevated far-end channel 148, respectively.

In an exemplary embodiment, the second continuity plate 180 comprises a second continuity plate outer surface 189, a second continuity plate attachment surface 170, a first second continuity plate end 182, and a second second continuity plate end 188. The second continuity plate attachment surface 170 comprises a first elevated near-end continuity groove 171, a first elevated far-end continuity groove 178, at least one second elevated continuity groove 175, and a third elevated continuity channel 176 communicating with the first elevated near-end continuity groove 171 and the first elevated far-end continuity groove 178.

The first elevated near-end continuity groove 171 is disposed substantially parallel and nearest to an edge of the first continuity plate end 182 and the first elevated far-end continuity groove 178 is disposed substantially parallel and nearest to an edge of the second continuity plate end 188. The at least one second elevated continuity groove 175 is disposed between the first elevated near-end continuity groove 171 and first elevated far-end continuity groove 178 and the third elevated continuity channel 176 is disposed between the first elevated near-end continuity groove 171 and first elevated far-end continuity groove 178 and is in communication therewith. The first elevated near-end continuity groove 171 is on a same plane (a first plane) as the first elevated far-end continuity groove 178. The at least one second elevated continuity groove 175 and the third elevated continuity channel 176 are on planes, different from that of the first elevated near-end continuity groove 171 (a second plane and a third plane), respectively. The elevation of the first plane is between the elevation of the second plane and third plane. The number of second elevated continuity grooves 175 is the same as the number of second elevated near-end continuity channels 148 and second elevated far-end continuity channels 122.

According to an exemplary embodiment, the number of the at least one second elevated near-end channel 122 is five, the at least one second elevated far-end channel 148 is five, the at least one second elevated continuity groove 175 is five, and the at least one second elevated continuity groove 164 is four; however, the embodiments are not limited thereto. Those of ordinary skill in the relevant art may readily appreciate that the number of the at least one second elevated near-end channel 122, the at least one second elevated far-end channel 148, and the at least one second elevated continuity groove 175 can be less than five or greater than five and the at least one second elevated continuity groove 164 can be less than four or greater than four, as long as the number of the at least one second elevated near-end channel 122, the at least one second elevated far-end channel 148, and the at least one second elevated continuity groove 175 is at least one, and are the same and the number of second elevated continuity grooves 164 is one less than the number of second elevated near-end channels 122, second elevated far-end channels 148, and second elevated continuity grooves 175. As an example and without limitation, if the number of the at least one second elevated near-end channel 122, the at least one second elevated far-end channel 148, and the at least one second elevated continuity groove 175 is one, then the number of the at least one second elevated continuity groove 164 is zero.

Generally, the shape and dimensions of the first elevated near-end channel 120, first elevated far-end channel 140, at least one second near-end elevated channel 122, and at least one second elevated far-end channel 148 are the same; however, the embodiments are not limited thereto.

According to an exemplary embodiment, the shape of the first elevated near-end channel 120, first elevated far-end channel 140, at least one second near-end elevated channel 122, and at least one second elevated far-end channel 148 are quadrilateral and the dimensions are the same; however, the embodiments are not limited thereto. Those of ordinary skill in the relevant art may readily appreciate that the shapes and the dimensions of the first elevated near-end channel 120, first elevated far-end channel 140, at least one second near-end elevated channel 122, and at least one second elevated far-end channel 148 may be non-quadrilateral and different, respectively, depending upon the application, as long as the first elevated near-end channel 120 is on a same plane (first plane) as the first elevated far-end channel 140 and the at least one second near-end elevated channel 122 is on a same plane as the at least one second far-end elevated channel 140 (second plane), and the elevation of the first plane and second plane are different and the first elevated near-end continuity groove 153 and first elevated near-end continuity groove 171 corresponds and communicates with the disposition and dimensions of the first elevated near-end channel 120, the first elevated far-end continuity groove 157 and first elevated far-end continuity groove 178 corresponds and communicates with the disposition and dimensions of the first elevated far-end channel 140, the second near-end elevated continuity groove 152 and one half of the at least one second elevated continuity groove 175 corresponds and communicates with the disposition and dimensions of the at least one second elevated near-end channel 122, and the second far-end elevated continuity groove 156 and one half of the at least one second elevated continuity groove 175 corresponds and communicates with the disposition and dimensions of the at least one second elevated far-end channel 148.

According to an exemplary embodiment, the pulse loop heat exchanger, under vacuum, has a working fluid therein and comprises different elevated channels and grooves. The working fluid is preferably distributed naturally in the form of liquid vapor slugs or bubbles inside of the channels and grooves. A reservoir is preferably provided to mitigate dry-out. The pulse loop heat exchanger comprises an evaporator region, a condenser region, and vapor flow channel regions extending from the evaporator region to the condenser region. When heat from a heat source is applied to the evaporator region, the heat converts the working fluid to vapor and the vapor bubbles become larger within the portion of the pulse loop heat exchanger. Meanwhile, at the condenser region, heat is being removed and the bubbles are reducing in size. The volume expansion due to vaporization and the contraction due to condensation cause an oscillating motion within the channels. The net effect of the temperature gradient between the evaporator and the condenser and the tensions introduced from the channels creates a non-equilibrium pressure condition. Thus, thermo-fluidic transport is provided via the self-sustaining oscillation driving forces with the pressure pulsations being fully thermally driven.

The thermo-fluidic transport is further enhanced by the three different elevation plane levels of the channels and grooves, increasing output pressure gain in downward working fluid flow, boosting oscillation driving forces and thus improving thermal performance.

Figure 2A:
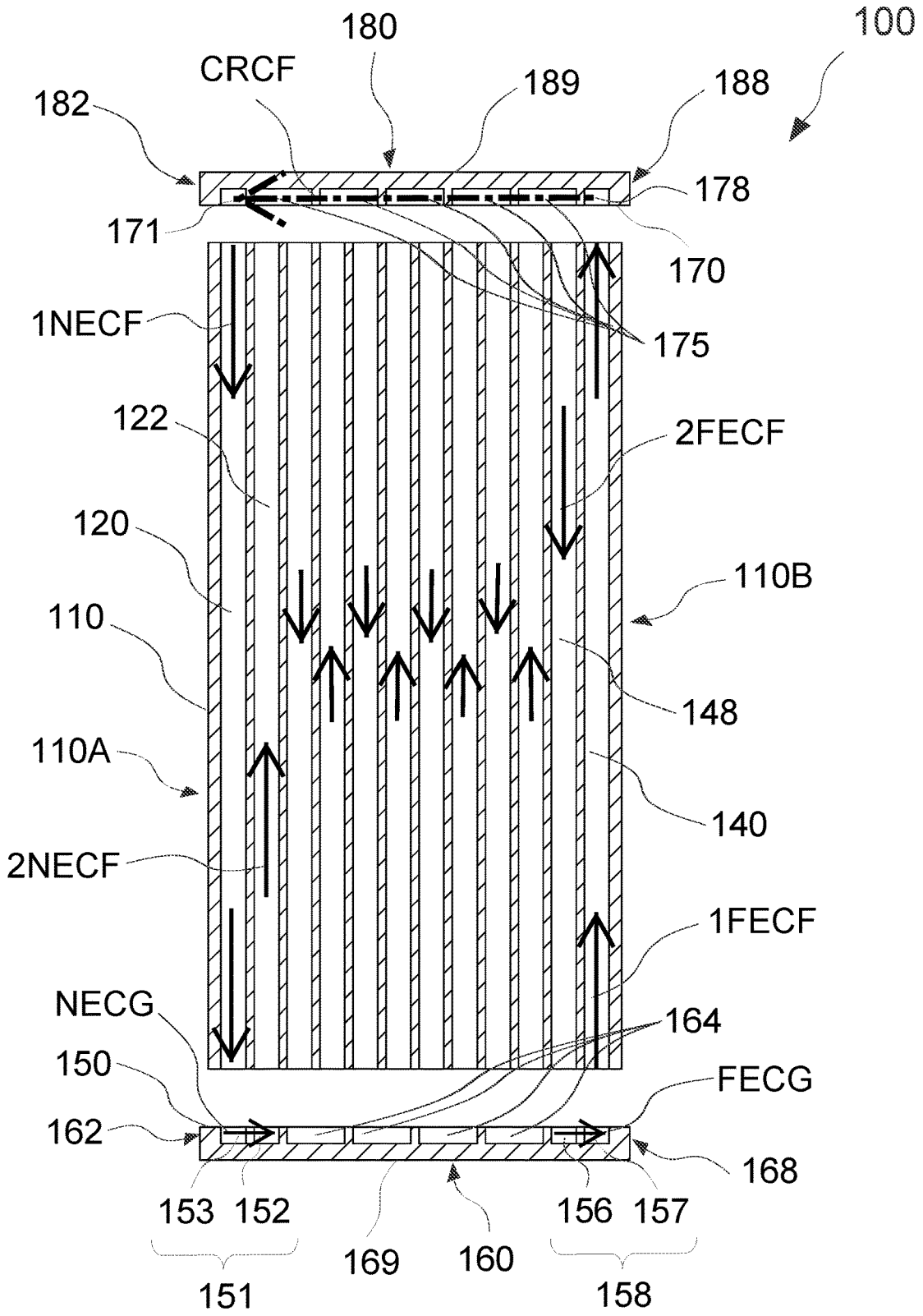
FIG. 2A is a schematic cross-sectional view of the pulse loop heat exchanger of FIG. 1A along line A-A in FIG. 1A, showing an example working fluid flow pattern according to an example embodiment.
Figure 2B:
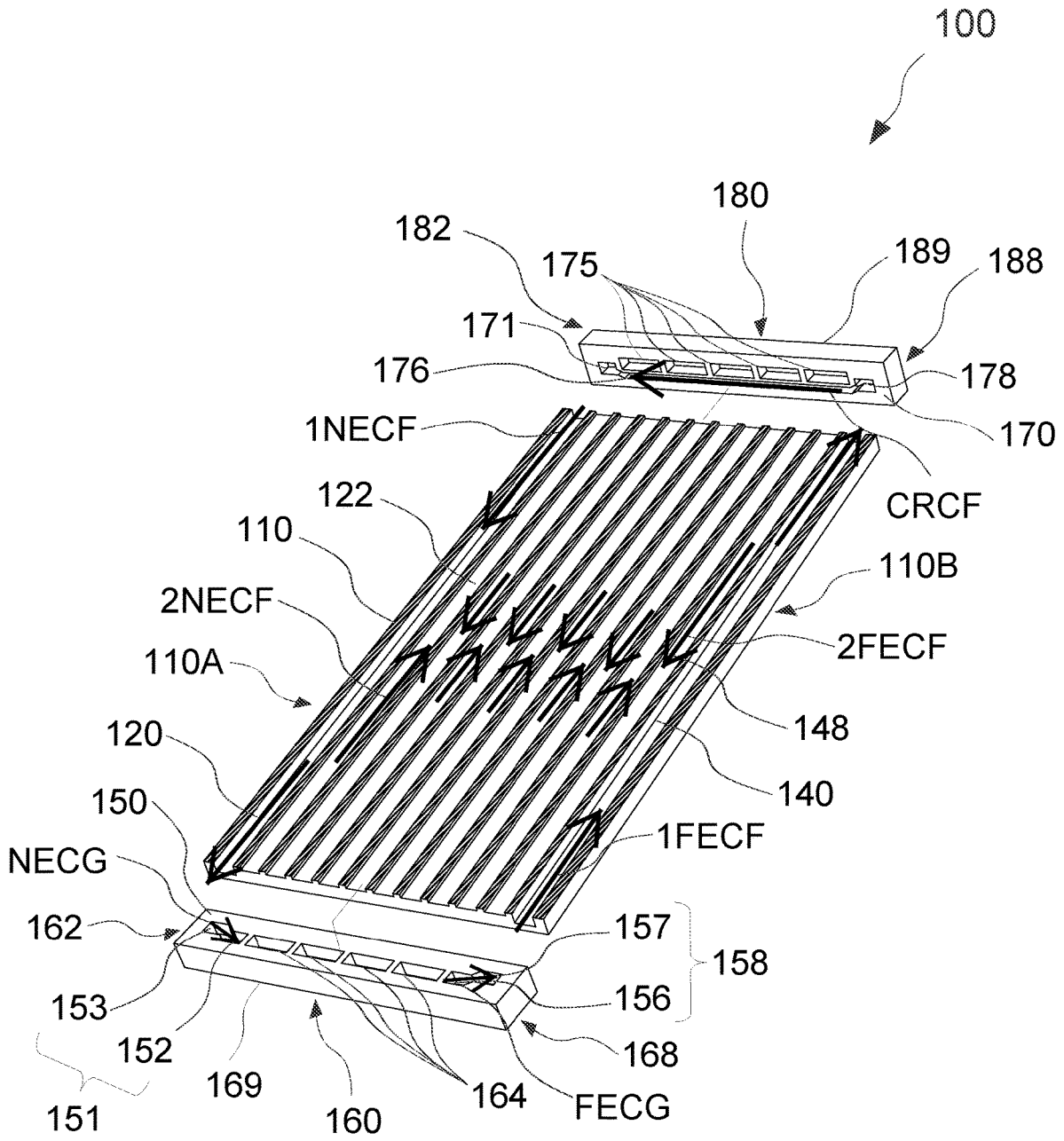
FIG. 2B is a schematic cross-sectional view a heat exchanger body of the pulse loop heat exchanger of FIG. 1A along line A-A in FIG. 1A, showing an example working fluid flow pattern according to an example embodiment.

FIG. 2A is a schematic cross-sectional view of the pulse loop heat exchanger of FIG. 1A along line A-A in FIG. 1A, showing a working fluid flow pattern according to an exemplary embodiment. FIG. 2B is a schematic cross-sectional view a heat exchanger body of the pulse loop heat exchanger of FIG. 1A along line A-A in FIG. 1A, showing a working fluid flow pattern according to an exemplary embodiment. Referring to FIGS. 2A and 2B, and referring to FIGS. 1A to 1C, in an exemplary embodiment the flow direction in the working fluid flow, in reference to the first elevated far-end channel 140 and first elevated near-end channel 120, may flow in a counter-clockwise direction before flowing back and forth throughout the at least one second elevated near-end channel 122, at least one second elevated far-end channel 148, and groove and channels of the second continuity plate attachment surface 170 and first continuity plate attachment surface 150, respectively; however, the embodiments are not limited thereto. Depending upon the disposition of the heat source applied to the pulse loop heat exchanger, the flow direction in the working fluid flow, in reference to the first elevated far-end channel 140 and first elevated near-end channel 120, may flow in a clockwise direction or a combination of a counter-clockwise and clockwise direction.

According to an exemplary embodiment, the working fluid flow in the first elevated far-end channel 140 flows 1 FECF to the first elevated far-end continuity groove 178 corresponding and communicating therewith at a same elevation level. Next, the working fluid flows CRCF to the third elevated continuity channel 176 communicating therewith at a lower elevation level. The oscillation driving forces are boosted via the downward working fluid flow to the third elevated continuity channel 176, increasing output pressure gain of the first elevated far-end continuity groove 178. The flow direction in the third elevated continuity channel 176 is perpendicular to the flow direction in the first elevated far-end channel 140 and is on a lower elevation level. Following, the working fluid flows CRCF to the first elevated near-end continuity groove 171 communicating therewith at a higher elevation level and then to the first elevated near-end channel 120 corresponding and communicating therewith at a same elevation level. The flow direction in the third elevated continuity channel 176 is perpendicular to the flow direction in first elevated near-end channel 120 and is on a lower elevation level. The working fluid flow in the first elevated near-end channel 120 flows 1 NECF to the first elevated near-end continuity groove 153 corresponding and communicating therewith at a same elevation level, before the working fluid flows NECG to a higher level of the second elevated near-end continuity groove 152 communicating with the first elevated near-end continuity groove 153, and then to the at least one second elevated near-end channel 122 corresponding and communicating therewith at a same elevation level. The flow direction in the at least one second elevated near-end channel 122 is opposite and parallel to the flow direction in first elevated near-end channel 120 and is on a higher elevation level. The working fluid flow in the at least one second elevated near-end channel 122 flows 2 NECF to the at least one second elevated continuity groove 175 corresponding and communicating therewith at a same elevation level, before flowing to the at least one second elevated far-end channel 148 corresponding and communicating therewith at a same elevation level. The working fluid flow in the at least one second elevated far-end channel 148 flows 2 FECF to the at least one second elevated continuity groove 164 corresponding and communicating therewith at a same elevation level, before continuing the back and forth flow direction movements. The flow direction in the at least one second elevated far-end channel 148 is opposite and parallel to the flow direction in the at least one second elevated near-end channel 122 and is on a same elevation level. The back and forth flow direction movements continue for another four cycles, before the working fluid flow in the at least one second elevated far-end channel 148 flows 2 FECF to the second elevated far-end continuity groove 156 corresponding and communicating therewith at a same elevation level. The working fluid flow in the second elevated far-end continuity groove 156 flows FECG to a lower level of the first elevated far-end continuity groove 157 communicating with second elevated far-end continuity groove 156 to start the flow process once again, flowing to the first elevated far-end channel 140 corresponding and communicating with the first elevated far-end continuity groove 157 at a same elevation level.

Figure 3:
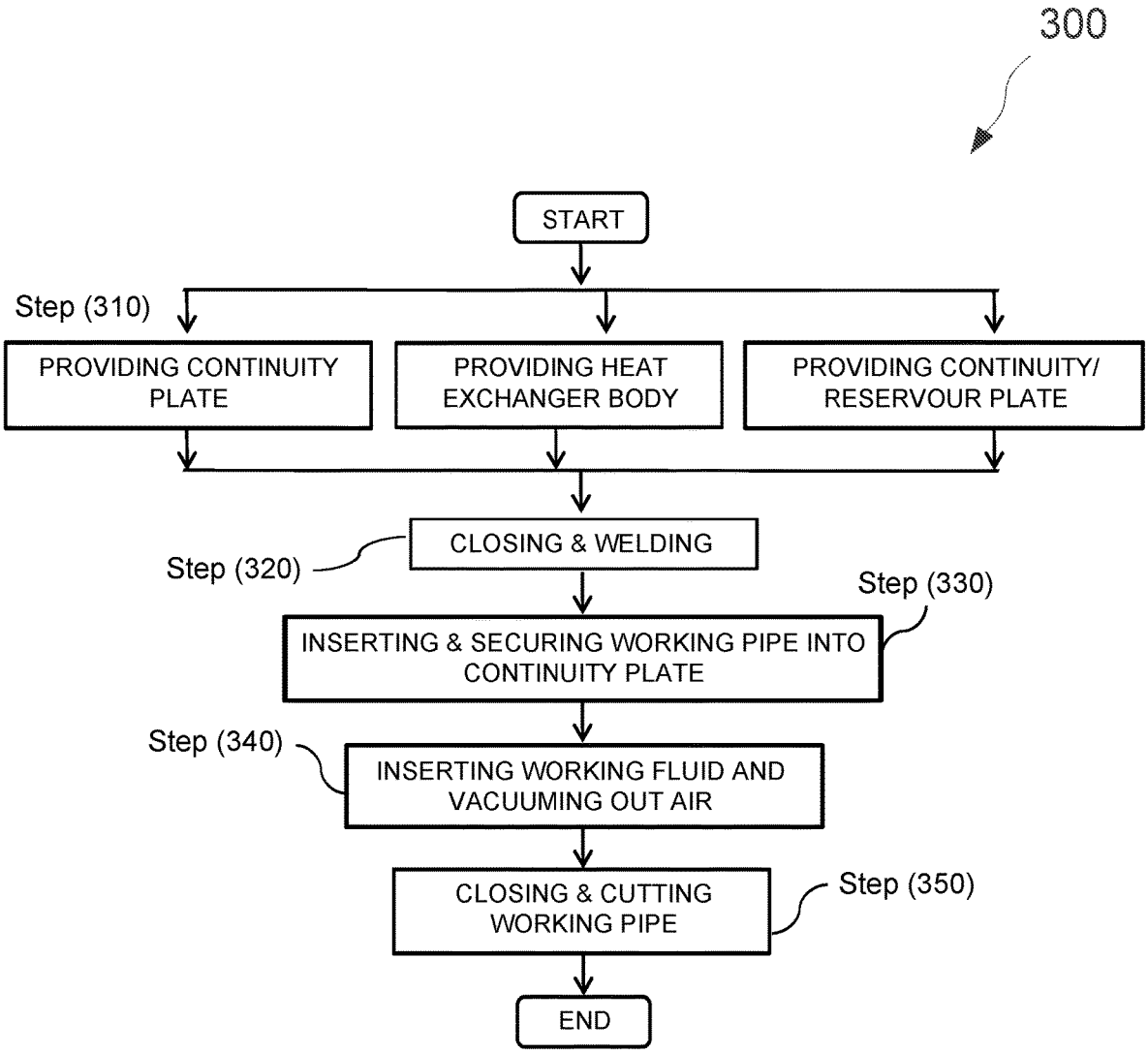
FIG. 3 is a flow chart illustrating a manufacturing method of a pulse loop heat exchanger, according to an example embodiment.
Figure 4A:
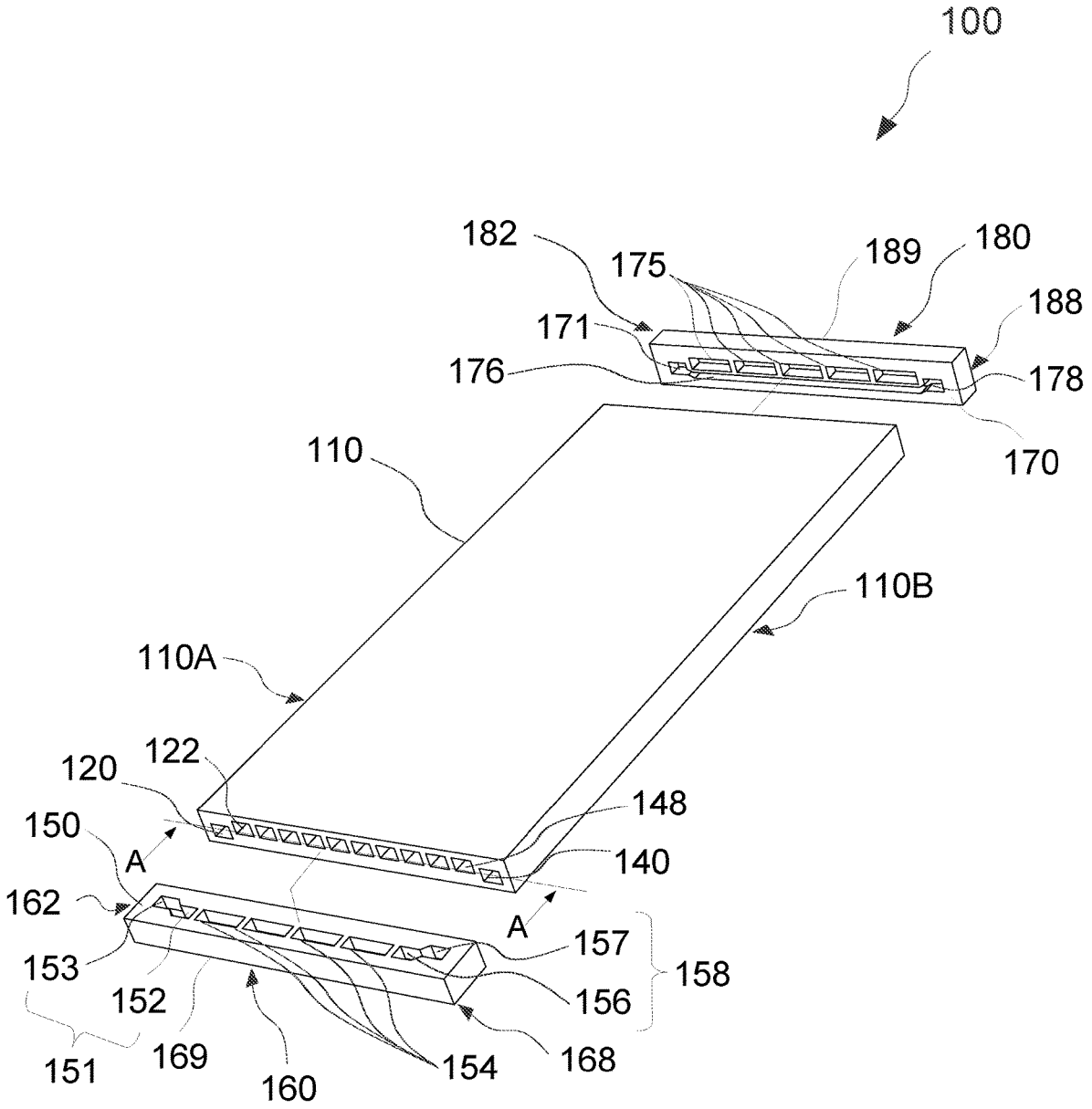
FIG. 4A is a schematic perspective view of the pulse loop heat exchanger of Step (310) of the manufacturing method of FIG. 3, according to an example embodiment.

FIG. 3 is a flow chart illustrating a manufacturing method of a pulse loop heat exchanger, according to an exemplary embodiment. FIG. 4A is a schematic perspective view of the pulse loop heat exchanger of Step (310) of the manufacturing method of FIG. 3, according to an example embodiment. Referring to FIGS. 3 to 4A, and referring to FIGS. 1A to 2B, the method 300 of manufacturing a pulse loop heat exchanger, under vacuum, having a working fluid therein, generally comprises three main steps, a providing step (step 310), a closing and welding step (step 320), and insertion, vacuuming and closing steps (Steps 330, 340, and 350). The first step, step 310, comprises providing a heat exchanger body 110, a first continuity plate 160, and a second continuity plate 180, such as those described above.

According to an exemplary embodiment, the heat exchanger body 110 is formed by an aluminum extrusion process. Generally, the extrusion process consists initially of heating an aluminum billet to an appropriate temperature, pushing the billet through a steel die by a hydraulic ram to form an aluminum extruded heat exchanger body, cooling the aluminum extruded heat exchanger body, stretching the aluminum extruded heat exchanger body to ensure straight profiles and release internal stresses, and then, cutting to form the heat exchanger body 110.

Following the aluminum extrusion process the heat exchanger body 110 is provided, comprising a near body end 110A having a first elevated near-end channel 120 and at least one second elevated near-end channel 122 and a far body end 1108 having a first elevated far-end channel 140 and at least one second elevated far-end channel 148. The first elevated near-end channel 120 is on a same plane (first plane) as the first elevated far-end channel 140 and the at least one second near-end elevated channel 122 is on a same plane as the at least one second far-end elevated channel 140 (a second plane). The elevation of the first plane is preferably different from that of the second plane.

In some embodiments, depending upon dimensions and application, axial or circumferential grooves acting as a wick structure, having triangular, rectangular, trapezoidal, reentrant, etc. cross-sectional geometries, may be formed on inner surfaces of the first elevated near-end channel 120, at least one second elevated near-end channel 122, first elevated far-end channel 140, and at least one second elevated far-end channel 148 via the steel die of the extrusion process. The wick structure may preferably be used to facilitate the flow of condensed fluid by capillary force back to the evaporation surface, keeping the evaporation surface wet for large heat fluxes.

According to an exemplary embodiment, a first continuity plate 160 and a second continuity plate 180 is made of aluminum, or an aluminum-alloy or the like, and formed by stamping; however, the embodiments are not limited thereto. Those of ordinary skill in the relevant art may readily appreciate that other manufacturing processes may be employed to form the first continuity plate 160 and a second continuity plate 180, such as CNC machining, and the embodiments are not limited thereto.

Following the stamping process the first continuity plate 160 is provided, comprising a continuity plate outer surface 169, a first continuity plate attachment surface 150, a first continuity plate end 162, and a second continuity plate end 168. The first continuity plate attachment surface 150 comprises a near-end continuity groove 151 having a first elevated near-end continuity groove 153 and a second elevated near-end continuity groove 152, a far-end continuity groove 158 having a first elevated far-end continuity groove 157 and a second elevated far-end continuity groove 156. In some embodiments, the first continuity plate attachment surface 150 further comprises at least one second elevated continuity groove 164. The first elevated near-end continuity groove 153 is on a same plane (a first plane) as the first elevated far-end continuity groove 157 and the second near-end elevated continuity groove 152 is on a same plane as the second far-end elevated continuity groove 156 (second plane). The elevation of the first plane is different from that of the second plane.

Following the stamping process the second continuity plate 180 is provided comprising a second continuity plate outer surface 189, a second continuity plate attachment surface 170, a first second continuity plate end 182, and a second second continuity plate end 188. The second continuity attachment surface 180 comprises a first elevated near-end continuity groove 171, a first elevated far-end continuity groove 178, at least one second elevated continuity groove 175, and a third elevated continuity channel 176 communicating with the first elevated near-end continuity groove 171 and the first elevated far-end continuity groove 178. The first elevated near-end continuity groove 171 is on a same plane (a first plane) as the first elevated far-end continuity groove 178. The at least one second elevated continuity groove 175 and the third elevated continuity channel 176 are on planes, different from that of the first elevated near-end continuity groove 171 (a second plane and a third plane), respectively. The elevation of the first plane is preferably between the elevation of the second plane and third plane.

Those of ordinary skill in the relevant art can readily appreciate that in alternative embodiments, further heat treatment processes can be employed throughout the manufacturing method of the pulse loop heat exchanger, and the embodiments are not limited to those described. Additionally, those skilled in the relevant art will appreciate that additional steps can be added to the process in order to incorporate additional features into the finished product. Also, the steps can be altered depending upon different requirements.

Figure 4B:
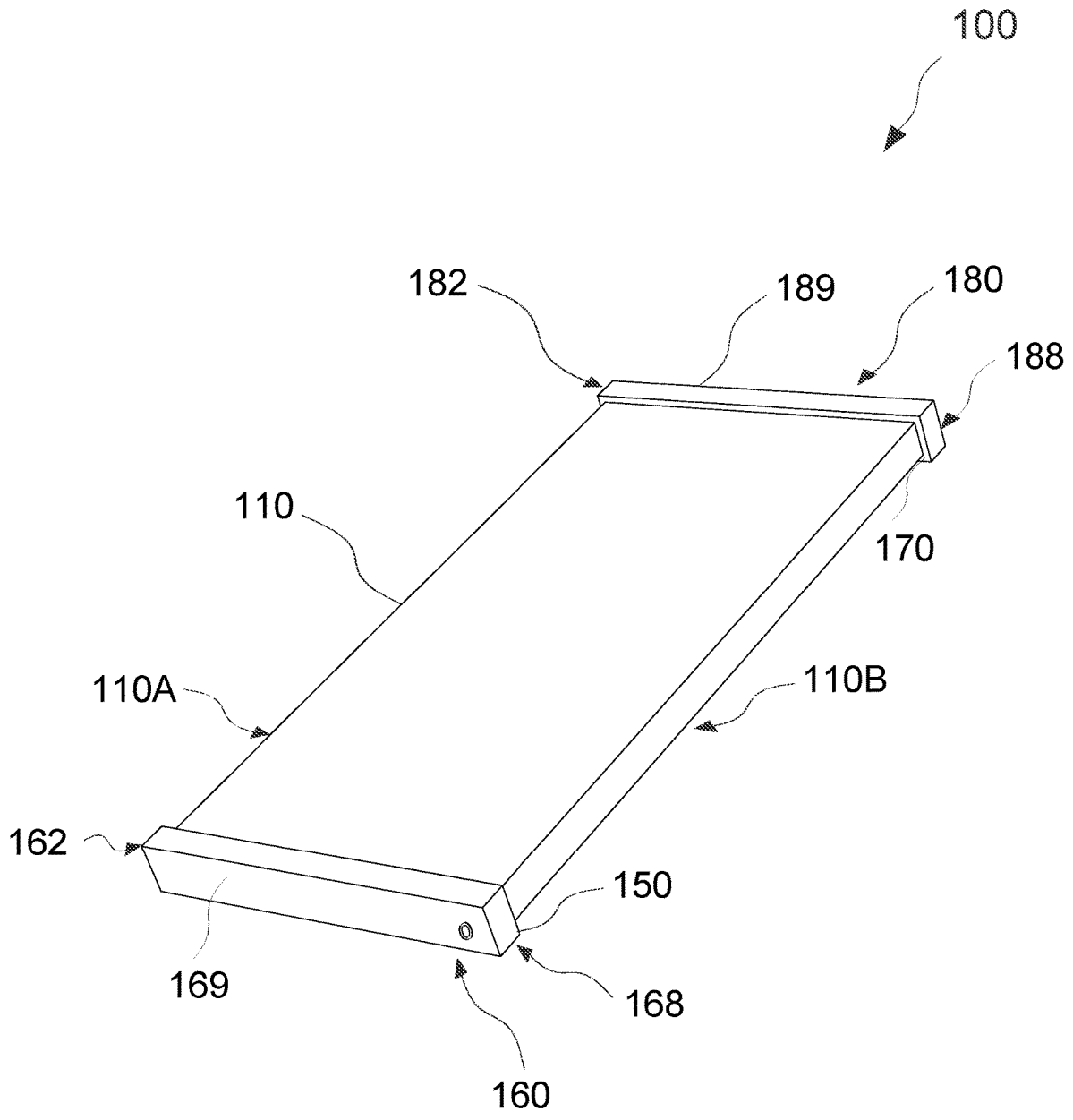
FIG. 4B is a schematic perspective view of the pulse loop heat exchanger of FIG. 4A following Step (320) of the manufacturing method of FIG. 3, according to an example embodiment.
Figure 4C:
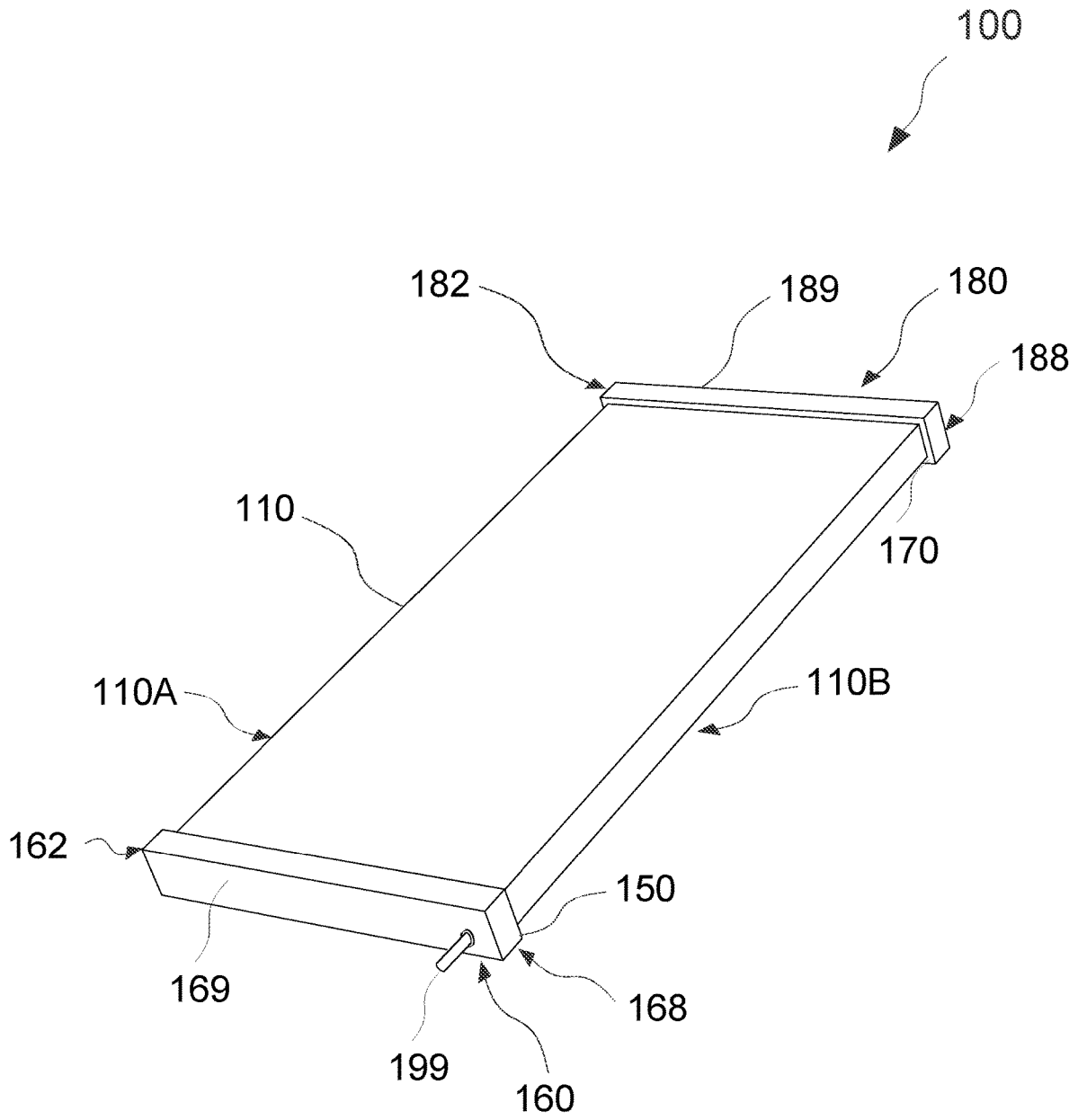
FIG. 4C is a schematic perspective view of the pulse loop heat exchanger of FIG. 4A following Step (340) of the manufacturing method of FIG. 3, according to an example embodiment.

FIG. 4B is a schematic perspective view of the pulse loop heat exchanger of FIG. 4A following Step (320) of the manufacturing method of FIG. 3, according to an exemplary embodiment. FIG. 4C is a schematic perspective view of the pulse loop heat exchanger of FIG. 4A following Step (340) of the manufacturing method of FIG. 3, according to an example embodiment. Referring to FIGS. 4B and 4C, and referring to FIGS. 1A to 4A, the method 300 further comprises step 320: closing and welding the first continuity plate 160 and second continuity plate 180 to the heat exchanger body 110; step 330: inserting and securing a fill tube into the first continuity plate 160; step 340: inserting a working fluid into the pulse loop heat exchanger 100 and vacuuming out air; and step 350: closing and cutting the fill tube.

Those of ordinary skill in the relevant art may readily appreciate that the fill tube may be inserted into a portion of the pulse loop heat exchanger 100, other than the first continuity plate 160 and the embodiments are not limited thereto. as All that is required is for a working fluid to be inserted into channels and grooves of the pulse loop heat exchanger 100 and air vacuumed out, resulting in an air-tight vacuum seal.

The relatively flat, straight lined welding portions of the first continuity plate 160 and second continuity plate 180 to the heat exchanger body 110 provide an effective method to close and seal the pulse loop heat exchanger 100, avoiding poor leak tightness and poor body strength thereabout; thus, decreasing the possibility of loss of working fluid and dry-out, without increasing the complexity of the manufacturing method.

In some embodiments, the working fluid is made of acetone; however, the embodiments are not limited thereto. Other working fluids can be employed, as can be common for those skilled in the relevant art. As a non-limiting example, the working fluid can comprise cyclopentane or n-hexane. As long as the working fluid can be vaporized by a heat source and the vapor can condense back to the working fluid and flow back to the heat source.

In some embodiments, any welding method as known by those skilled in the relevant art, such as ultrasonic welding, diffusion welding, laser welding and the like, can be employed, as long as a vacuum seal can be achieved.

In some embodiments, the diameters of the at least one second elevated near-end channel 122 and at least one second elevated far-end channel 148 are the same and larger than the diameters of the first elevated near-end channel 120 and first elevated far-end channel 140, however, the embodiments are not limited thereto. Those of ordinary skill in the art may readily appreciate that the diameters of the channels may be of varying sizes, larger or smaller, and of various amounts, depending upon application and size of the pulse loop heat exchanger 100. As long as the working fluid is able to freely flow throughout the channels and grooves.

Figure 5A:
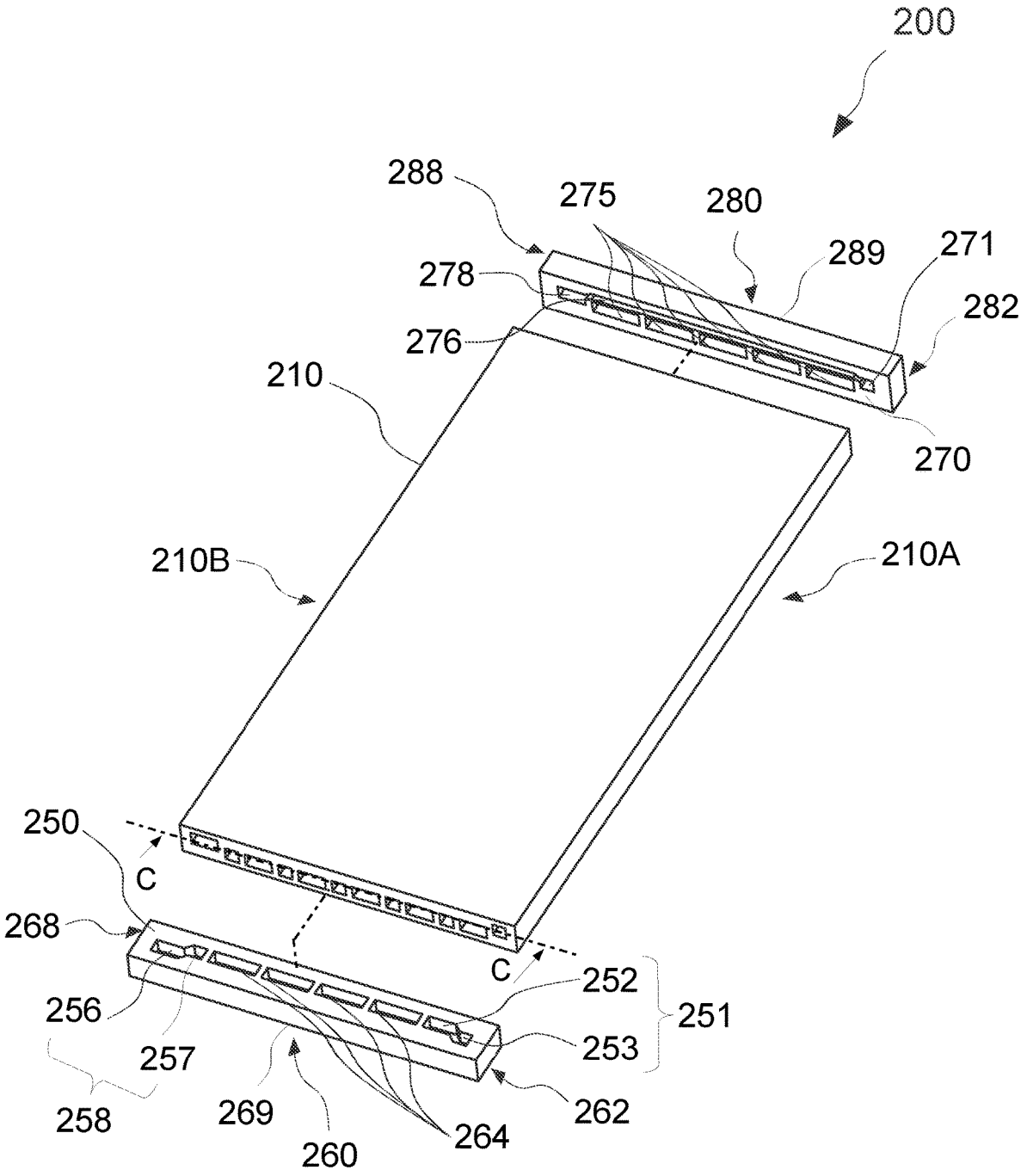
FIG. 5A is an exploded view of an alternative pulse loop heat exchanger, according to an example embodiment.
Figure 5B:
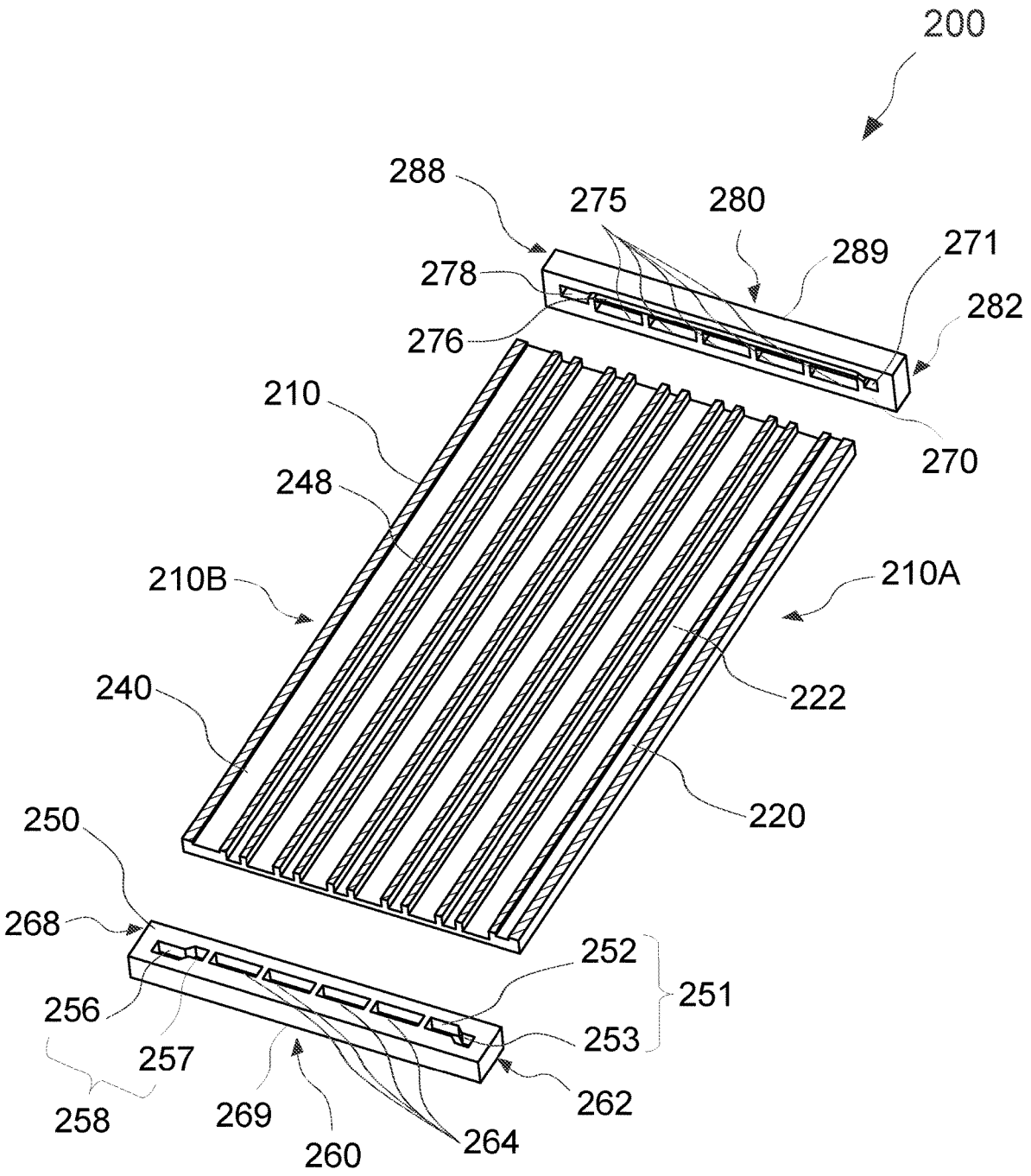
FIG. 5B is a schematic cross-sectional view of the heat exchanger body of the pulse loop heat exchanger of FIG. 5A along line C-C in FIG. 5A, according to an example embodiment.

FIG. 5A is an exploded view of an alternative pulse loop heat exchanger, according to an exemplary embodiment. FIG. 5B is a schematic cross-sectional view of the heat exchanger body of the pulse loop heat exchanger of FIG. 5A along line C-C in FIG. 5A, according to an exemplary embodiment. Referring to FIGS. 5A and 5B, an alternative pulse loop heat exchanger 200 is provided, comprising a first continuity plate 260, a second continuity plate 280 and a heat exchanger body 210. The heat exchanger body 210 comprises a near body end 210A having a first elevated near-end channel 220 and at least one second elevated near-end channel 222 and a far body end 2108 having a first elevated far-end channel 240 and at least one second elevated far-end channel 248. The first elevated near-end channel 220 is disposed substantially parallel and nearest to an edge of the first body end 210A and the at least one second near-end elevated channel 222 is disposed substantially parallel and sequentially next to the first elevated near-end channel 220. The first elevated far-end channel 240 is disposed substantially parallel and nearest to an edge of the second body end 2108 and the at least one second elevated far-end channel 248 is disposed substantially parallel and sequentially next to the first elevated far-end channel 240. The first elevated near-end channel 220 is on a same plane (a first plane) as the first elevated far-end channel 240 and the at least one second near-end elevated channel 222 is on a same plane as the at least one second far-end elevated channel 248 (a second plane). The elevation of the first plane is different from that of the second plane. The number of the at least one second elevated near-end channel 222 and the at least one second elevated far-end channel 248 is the same.

According to an exemplary embodiment, the continuity plate 260 comprises a continuity plate outer surface 269, a continuity plate attachment surface 250, a first continuity plate end 262, and a second continuity plate end 268. The continuity plate attachment surface 250 comprises a near-end continuity groove 251 having a first elevated near-end continuity groove 253 and a second elevated near-end continuity groove 252, a far-end continuity groove 258 having a first elevated far-end continuity groove 257 and a second elevated far-end continuity groove 256. In some embodiments, the continuity plate attachment surface 250 further comprises at least one second elevated continuity groove 264. The first elevated near-end continuity groove 253 is disposed substantially parallel and nearest to an edge of the first continuity plate end 262 and the second elevated near-end continuity groove 252 is disposed sequentially next to the first elevated near-end continuity groove 253 and is in communication therewith. The first elevated far-end continuity groove 256 is disposed substantially parallel and nearest to an edge of the second continuity plate end 268 and the second elevated far-end continuity groove 257 is disposed sequentially next to the first elevated far-end continuity groove 256 and is in communication therewith. In some embodiments, the at least one second elevated continuity groove 264 is disposed between the second elevated near-end continuity groove 252 and the second elevated far-end continuity groove 257. The first elevated near-end continuity groove 253 is on a same plane (a first plane) as the first elevated far-end continuity groove 256 and the second near-end elevated continuity groove 252 is on a same plane as the second far-end elevated continuity groove 257 (a second plane). The first elevated near-end continuity groove 253 corresponds and communicates with the disposition and dimensions of the first elevated near-end channel 220. The first elevated far-end continuity groove 256 corresponds and communicates with the disposition and dimensions of the first elevated far-end channel 240. The second near-end elevated continuity groove 252 corresponds and communicates with the disposition and dimensions of the at least one second elevated near-end channel 222. The second far-end elevated continuity groove 257 corresponds and communicates with the disposition and dimensions of the at least one second elevated far-end channel 248. In some embodiments, the at least one second elevated continuity groove 264 is on a same plane as the second near-end elevated continuity groove 252 and the second far-end elevated continuity groove 257 (a second plane). In some embodiments, the at least one second elevated continuity groove 264 corresponds and communicates with the disposition and dimensions of at least one second elevated near-end channel 222 and a at least one second elevated far-end channel 248. The elevation of the first plane is different from that of the second plane. The number of the second elevated near-end continuity groove 252 and the second elevated far-end continuity groove 257, respectively, is the same. In some embodiments, the number of the at least one second elevated continuity groove 264 is one, two, three, four or greater. As an example and not to be limiting, if the number of second elevated near-end channels 222 and second elevated far-end channels 248 is three, respectively, then two second elevated continuity grooves 264 would correspond and communicate with the disposition and dimensions of respective second and third elevated near-end channels 222 and respective second and third elevated far-end channels 248, respectively.

According to an exemplary embodiment, the second continuity plate 280 comprises a second continuity plate outer surface 289, a second continuity plate attachment surface 270, a first second continuity plate end 282, and a second second continuity plate end 288. The second continuity attachment surface 270 comprises a first elevated near-end continuity groove 271, a first elevated far-end continuity groove 278, at least one second elevated continuity groove 275, and a third elevated continuity channel 276 communicating with the first elevated near-end continuity groove 271 and the first elevated far-end continuity groove 278.

The first elevated near-end continuity groove 271 is disposed substantially parallel and nearest to an edge of the first second continuity plate end 282 and the first elevated far-end continuity/reservoir groove 278 is disposed substantially parallel and nearest to an edge of the second second continuity plate end 288. The at least one second elevated continuity/reservoir groove 275 is disposed between the first elevated near-end continuity/reservoir groove 271 and first elevated far-end continuity/reservoir groove 278 and the third elevated continuity channel 276 is disposed between the first elevated near-end continuity/reservoir groove 271 and first elevated far-end continuity/reservoir groove 278 and is in communication therewith. The first elevated near-end continuity/reservoir groove 271 is on a same plane (a first plane) as the first elevated far-end continuity/reservoir groove 278. The at least one second elevated continuity/reservoir groove 275 and the third elevated continuity channel 276 are on planes that are different from that of the first elevated near-end continuity/reservoir groove 271 (a second plane and a third plane), respectively. The elevation of the first plane is preferably between the elevation of the second plane and third plane. The number of second elevated continuity grooves 275 is the same as the number of second elevated near-end continuity grooves 222 and the second elevated far-end continuity groove 248.

According to an exemplary embodiment, the number of the at least one second elevated near-end channels 222 is five, the at least one second elevated far-end channels 248 is five, the at least one second elevated continuity/reservoir grooves 275 is five, and the at least one second elevated continuity grooves 264 is four; however, the embodiments are not limited thereto.

According to the exemplary embodiment of FIGS. 5A-5B, the shape of the first elevated near-end channel 220, first elevated far-end channel 240, at least one second near-end elevated channel 222, and at least one second elevated far-end channel 248 are quadrilateral and the dimensions are not all the same. The width of the first elevated near-end channel 220 is smaller than the width of the first elevated far-end channel 240 and the widths of the sequential at least one second near-end elevated channel 222 and sequential at least one second elevated far-end channel 248 alternate either from a larger width to a smaller width and back to a larger width channel or a smaller width to a larger width and then back to a smaller width channel, and so on. That is, in this exemplary embodiment the second near-end elevated channels 222 and second far-end elevated channels 248 alternate in sequence, and all second near-end elevated channels 222 have the same width, and all second far-end elevated channels 248 have the same width that is smaller than the width of the second near-end elevated channels 222. Generally, the dimensions of the smaller widths are the same and the dimensions of the larger widths are the same; however, the embodiments are not limited thereto. Those of ordinary skill in the relevant art may readily appreciate that the shapes and the dimensions of the first elevated near-end channel 220, first elevated far-end channel 240, at least one second near-end elevated channel 222, and at least one second elevated far-end channel 248 may be non-quadrilateral and different, respectively, depending upon application, as long as the first elevated near-end channel 220 is on a same plane (a first plane) as the first elevated far-end channel 240 and the at least one second near-end elevated channel 222 is on a same plane as the at least one second far-end elevated channel 240 (a second plane), and the elevation of the first plane and second plane are different and the first elevated near-end continuity groove 253 and first elevated near-end continuity/reservoir groove 271 corresponds and communicates with the disposition and dimensions of the first elevated near-end channel 220, the first elevated far-end continuity groove 256 and first elevated far-end continuity/reservoir groove 278 corresponds and communicates with the disposition and dimensions of the first elevated far-end channel 240, the second near-end elevated continuity groove 252 and a portion of the at least one second elevated continuity/reservoir groove 275 corresponds and communicates with the disposition and dimensions of the at least one second elevated near-end channel 222, and the second far-end elevated continuity groove 257 and a portion of the at least one second elevated continuity/reservoir groove 275 corresponds and communicates with the disposition and dimensions of the at least one second elevated far-end channel 248.

In some embodiments, the diameters of the at least one second elevated near-end channel 222 and at least one second elevated far-end channel 248 are the same and larger than the diameters of the first elevated near-end channel 220 and first elevated far-end channel 240. Also, in some embodiments, the first elevated near-end channel 220 is disposed parallel and nearest to an edge of the first body end 210A and the at least one second near-end elevated channel 222 is disposed parallel and sequentially next to the first elevated near-end channel 220 and the first elevated far-end channel 240 is disposed parallel and nearest to an edge of the second body end 210B and the at least one second elevated far-end channel 248 is disposed parallel and sequentially next to the first elevated far-end channel 240. However, the embodiments are not limited thereto. Those of ordinary skill in the art may readily appreciate that the diameters of the channels may be of varying sizes, larger or smaller, parallel or not parallel to an edge of the first body end 210A or second body end 210B, and of various amounts, depending upon application and size of the pulse loop heat exchanger 200. As long as the working fluid is able to freely flow throughout the channels and grooves.

Figure 6A:
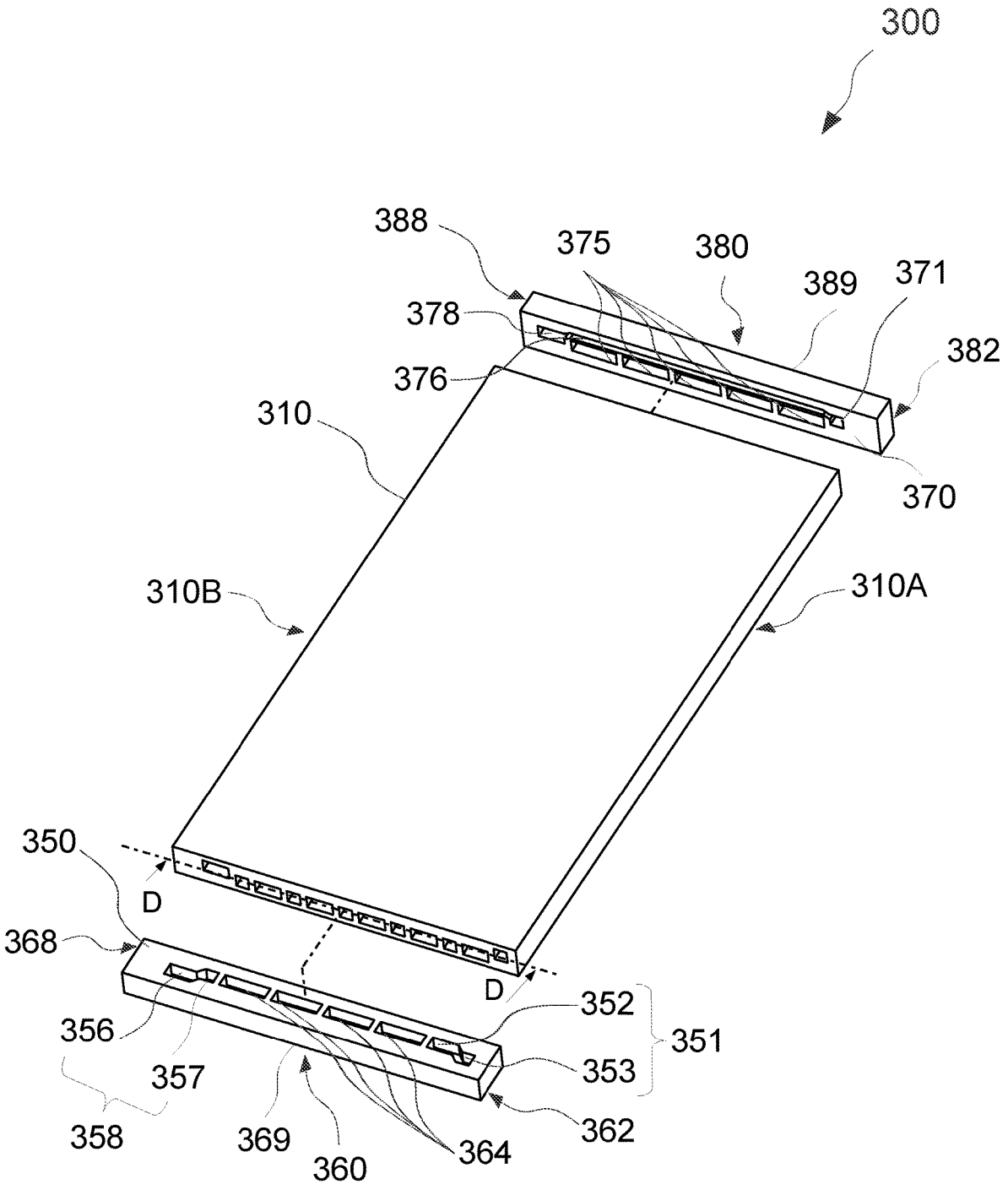
FIG. 6A is an exploded view of another alternative pulse loop heat exchanger, according to an example embodiment.
Figure 6B:
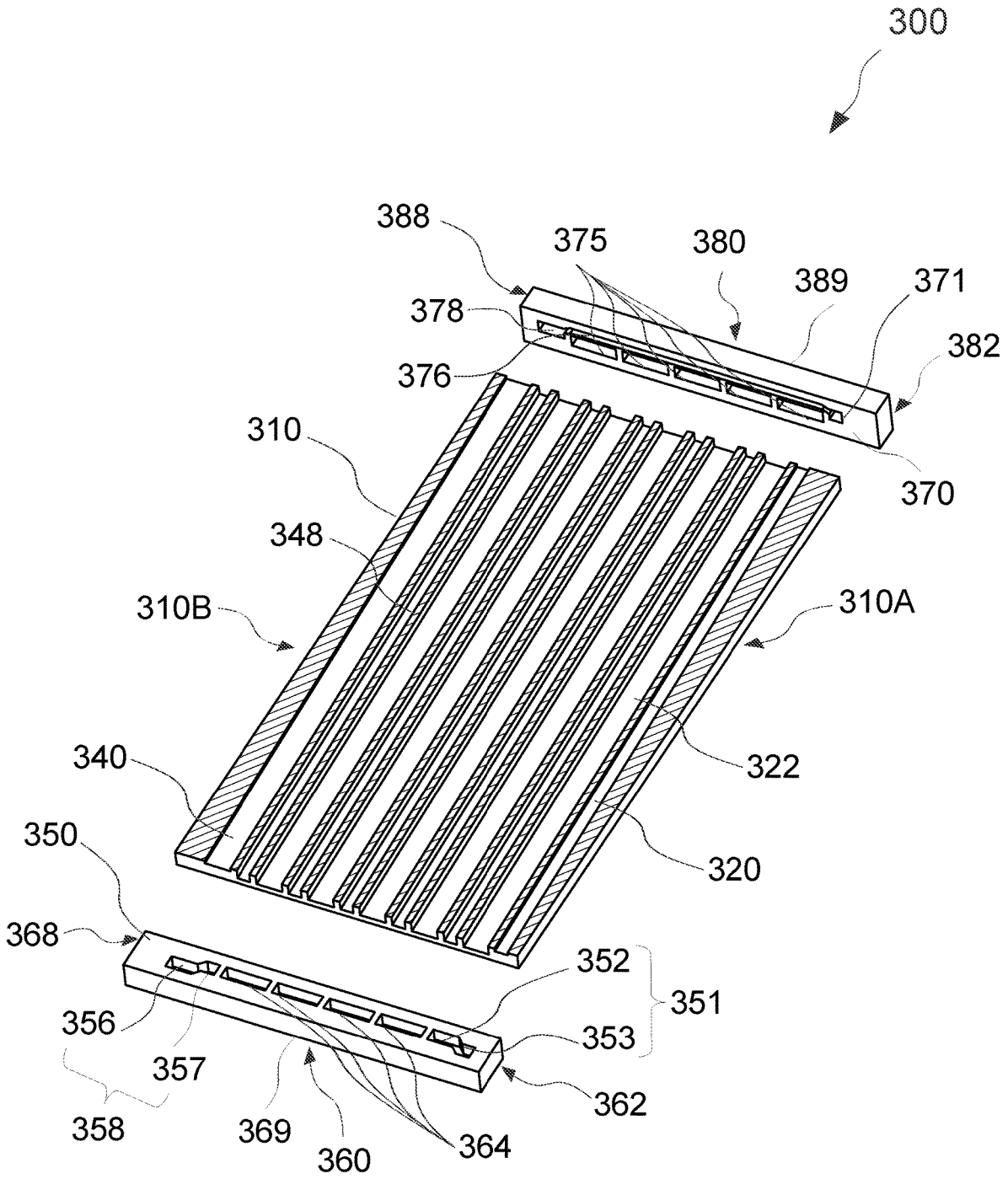
FIG. 6B is a schematic cross-sectional view of the heat exchanger body of the pulse loop heat exchanger of FIG. 6A along line D-D in FIG. 6A, according to an example embodiment.

FIG. 6A is an exploded view of another alternative pulse loop heat exchanger, according to an example embodiment. FIG. 6B is a schematic cross-sectional view of the heat exchanger body of the pulse loop heat exchanger of FIG. 6A along line D-D in FIG. 6A, according to an exemplary embodiment. Referring to FIGS. 6A and 6B, another alternative pulse loop heat exchanger 300 is provided, comprising a first continuity plate 360, a second continuity plate 380 and a heat exchanger body 310. The heat exchanger body 310 comprises a near body end 310A having a first elevated near-end channel 320 and at least one second elevated near-end channel 322 and a far body end 310B having a first elevated far-end channel 340 and at least one second elevated far-end channel 348. The first elevated near-end channel 320 is disposed nearest to an edge of the first body end 310A and at an angle thereto. The at least one second near-end elevated channel 322 is disposed substantially parallel and sequentially next to the first elevated near-end channel 320. The first elevated far-end channel 340 is disposed nearest to an edge of the second body end 310B and at an angle thereto. The at least one second elevated far-end channel 348 is disposed substantially parallel and sequentially next to the first elevated far-end channel 340. The first elevated near-end channel 320 is on a same plane (a first plane) as the first elevated far-end channel 340 and the at least one second near-end elevated channel 322 is on a same plane as the at least one second far-end elevated channel 348 (a second plane). The elevation of the first plane is different from that of the second plane. The number of the at least one second elevated near-end channel 322 and the at least one second elevated far-end channel 348 is the same.

According to an exemplary embodiment, the continuity plate 360 comprises a continuity plate outer surface 369, a continuity plate attachment surface 350, a first continuity plate end 362, and a second continuity plate end 368. The continuity plate attachment surface 350 comprises a near-end continuity groove 351 having a first elevated near-end continuity groove 353 and a second elevated near-end continuity groove 352, a far-end continuity groove 358 having a first elevated far-end continuity groove 356 and a second elevated far-end continuity groove 357. In some embodiments, the continuity plate attachment surface 350 further comprises at least one second elevated continuity groove 364. The first elevated near-end continuity groove 353 is disposed nearest to an edge of the first continuity plate end 362 and the second elevated near-end continuity groove 352 is disposed sequentially next to the first elevated near-end continuity groove 353 and is in communication therewith. The first elevated far-end continuity groove 356 is disposed nearest to an edge of the second continuity plate end 368 and the second elevated far-end continuity groove 357 is disposed sequentially next to the first elevated far-end continuity groove 356 and is in communication therewith. In some embodiments, the at least one second elevated continuity groove 364 is disposed between the second elevated near-end continuity groove 352 and the second elevated far-end continuity groove 357. The first elevated near-end continuity groove 353 is on a same plane (a first plane) as the first elevated far-end continuity groove 356 and the second near-end elevated continuity groove 352 is on a same plane as the second far-end elevated continuity groove 357 (a second plane). The first elevated near-end continuity groove 353 corresponds and communicates with the disposition and dimensions of the first elevated near-end channel 320. The first elevated far-end continuity groove 356 corresponds and communicates with the disposition and dimensions of the first elevated far-end channel 340. The second near-end elevated continuity groove 352 corresponds and communicates with the disposition and dimensions of the at least one second elevated near-end channel 322. The second far-end elevated continuity groove 357 corresponds and communicates with the disposition and dimensions of the at least one second elevated far-end channel 348. In some embodiments, the at least one second elevated continuity groove 364 is on a same plane as the second near-end elevated continuity groove 352 and the second far-end elevated continuity groove 357 (a second plane). In some embodiments, the at least one second elevated continuity groove 364 corresponds and communicates with the disposition and dimensions of a second elevated near-end channel 322 and at least one second elevated far-end channel 348. The elevation of the first plane is different from that of the second plane. The number of the second elevated near-end continuity groove 352 and the second elevated far-end continuity groove 357, respectively, is the same. In some embodiments, the number of the at least one second elevated continuity groove 364 is zero, one, two, three, four or greater. As an example and not to be limiting, if the number of second elevated near-end channels 322 and second elevated far-end channels 348 is three, respectively, then two second elevated continuity grooves 364 would correspond and communicate with the disposition and dimensions of respective second and third elevated near-end channels 322 and respective second and third elevated far-end channels 348.

According to an exemplary embodiment, the second continuity plate 380 comprises a second continuity plate outer surface 389, a second continuity plate attachment surface 370, a first second continuity plate end 382, and a second second continuity plate end 388. The continuity/reservoir attachment surface 370 comprises a first elevated near-end continuity/reservoir groove 371, a first elevated far-end continuity/reservoir groove 378, at least one second elevated continuity/reservoir groove 375, and a third elevated continuity channel 376 communicating with the first elevated near-end continuity/reservoir groove 371 and the first elevated far-end continuity/reservoir groove 378.

The first elevated near-end continuity/reservoir groove 371 is disposed nearest to an edge of the first second continuity plate end 382 and the first elevated far-end continuity/reservoir groove 378 is disposed nearest to an edge of the second second continuity plate end 388. The at least one second elevated continuity/reservoir groove 375 is disposed between the first elevated near-end continuity/reservoir groove 371 and first elevated far-end continuity/reservoir groove 378 and the third elevated continuity channel 376 is disposed between the first elevated near-end continuity/reservoir groove 371 and first elevated far-end continuity/reservoir groove 378 and is in communication therewith. The first elevated near-end continuity/reservoir groove 371 is on a same plane (a first plane) as the first elevated far-end continuity/reservoir groove 378. The at least one second elevated continuity/reservoir groove 375 and the third elevated continuity channel 376 are on planes that are different from that of the first elevated near-end continuity/reservoir groove 371 (a second plane and a third plane), respectively. The elevation of the first plane is between the elevation of the second plane and third plane. The number of the at least one second elevated continuity/reservoir grooves 375 is the same as the number of the second elevated near-end continuity groove 352 and the second elevated far-end continuity groove 357.

According to an exemplary embodiment, the number of the at least one second elevated near-end channel 322 is five, the at least one second elevated far-end channel 348 is five, the at least one second elevated continuity/reservoir groove 375 is five, and the at least one second elevated continuity groove 364 is four; however, the embodiments are not limited thereto.

According to an exemplary embodiment, the shape of the first elevated near-end channel 320, first elevated far-end channel 340, at least one second near-end elevated channel 322, and at least one second elevated far-end channel 348 are quadrilateral and the dimensions are not all the same. The width of the first elevated near-end channel 320 is smaller than the width of the first elevated far-end channel 340 and the widths of the sequential at least one second near-end elevated channel 322 and sequential at least one second elevated far-end channel 348 alternate either from a larger width to a smaller width and back to a larger width channel or a smaller width to a larger width and then back to a smaller width channel, and so on. That is, in this exemplary embodiment the second near-end elevated channels 322 and second far-end elevated channels 348 alternate in sequence, and all second near-end elevated channels 322 have the same width, and all second far-end elevated channels 348 have the same width that is smaller than the width of the second near-end elevated channels 322. Generally, the dimensions of the smaller widths are the same and the dimensions of the larger widths are the same; however, the embodiments are not limited thereto.

According to an exemplary embodiment, the first elevated near-end channel 320 is disposed nearest to an edge of the first body end 310A and at an angle thereto and the at least one second near-end elevated channel 322 is disposed substantially parallel and sequentially next to the angled first elevated near-end channel 320. The first elevated far-end channel 340 is disposed nearest to an edge of the second body end 310B at an angle thereto and the at least one second elevated far-end channel 348 is disposed substantially parallel and sequentially next to the angled first elevated far-end channel 340. In the illustrated embodiment, the end of the first elevated near-end channel 320 nearest to the edge of the first body end 310A is the end where the first elevated near-end channel 320 communicates with the first elevated near-end continuity groove 353. Because channel 320 is at an angle relative to edge 310A, the distance from the edge of the first body end 310A where the first elevated near-end channel 320 communicates with the first elevated near-end continuity groove 371 is greater than the distance from the edge of the first body end 310A where the first elevated near-end channel 320 communicates with the first elevated near-end continuity groove 353. Similarly, the distance from the edge of the second body end 310B where the first elevated far-end channel 340 communicates with the second far-end elevated continuity groove 356 is greater than the distance from the edge of the first body end 310A where the first elevated near-end channel 320 communicates with the second second continuity plate end 378. However, the embodiments are not limited thereto.

Figure 7A:
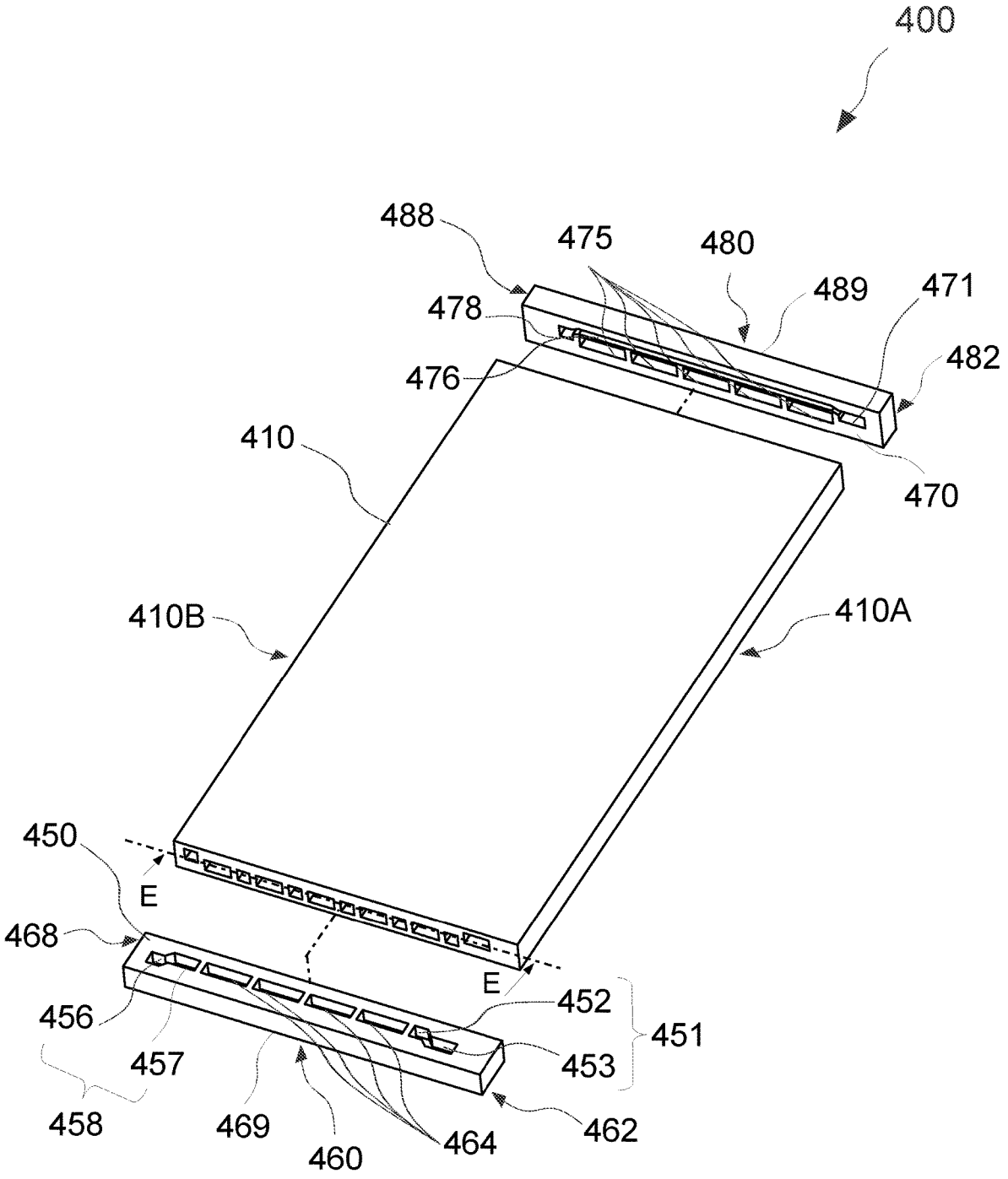
FIG. 7A is an exploded view of yet another alternative pulse loop heat exchanger, according to an example embodiment.
Figure 7B:
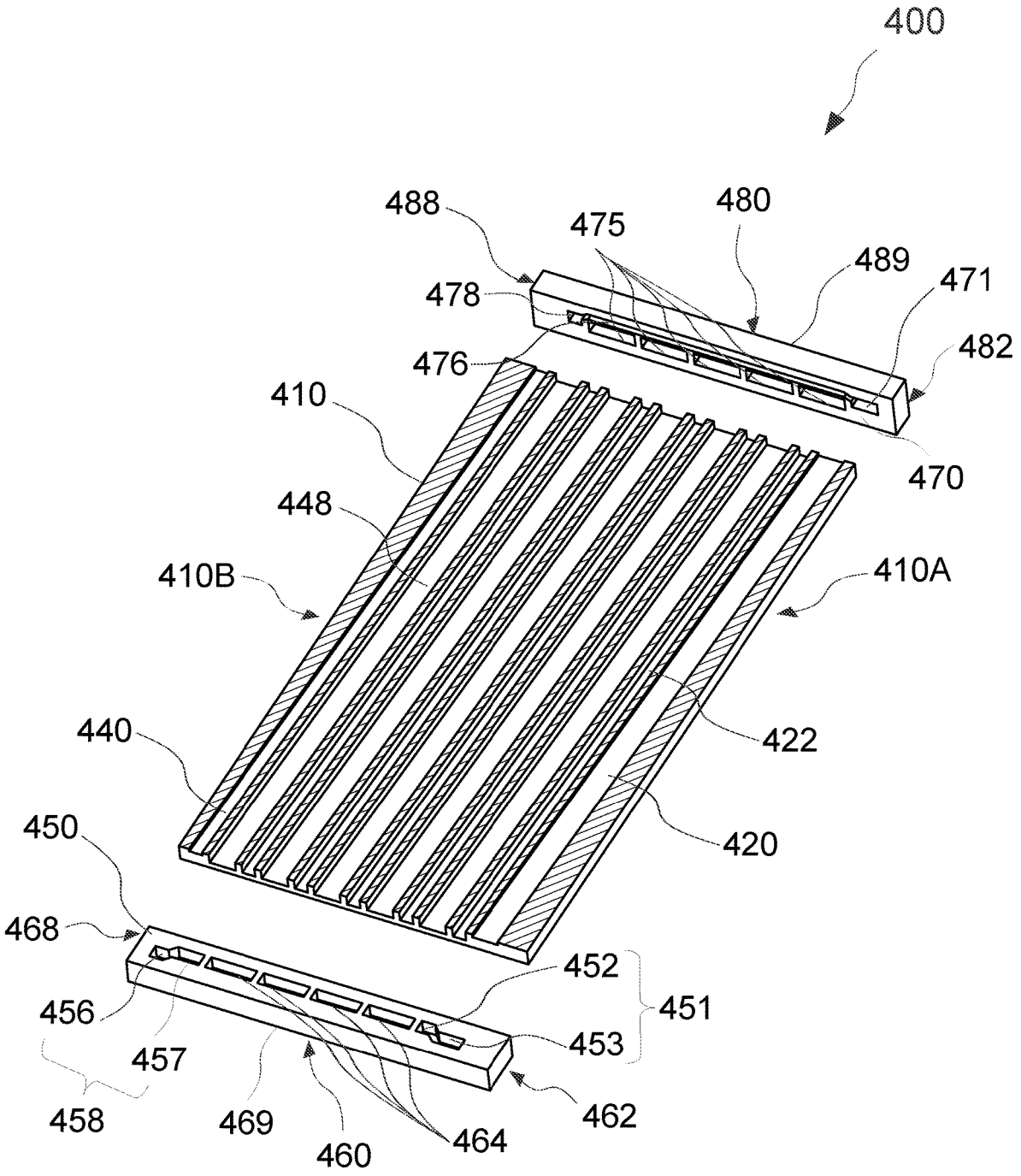
FIG. 7B is a schematic cross-sectional view of the heat exchanger body of the pulse loop heat exchanger of FIG. 7A along line E-E in FIG. 7A, according to an example embodiment.

FIG. 7A is an exploded view of yet another alternative pulse loop heat exchanger, according to an example embodiment. FIG. 7B is a schematic cross-sectional view of the heat exchanger body of the pulse loop heat exchanger of FIG. 7A along line E-E in FIG. 7A, according to an exemplary embodiment. Referring to FIGS. 7A and 7B, yet another alternative pulse loop heat exchanger 400 is provided, comprising a first continuity plate 460, a second continuity plate 480 and a heat exchanger body 410. The heat exchanger body 410 comprises a near body end 410A having a first elevated near-end channel 420 and at least one second elevated near-end channel 422 and a far body end 410B having a first elevated far-end channel 440 and at least one second elevated far-end channel 448. The first elevated near-end channel 420 is disposed nearest to an edge of the first body end 410A and at an angle thereto. The at least one second near-end elevated channel 422 is disposed substantially parallel and sequentially next to the first elevated near-end channel 420. The first elevated far-end channel 440 is disposed nearest to an edge of the second body end 410B and at an angle thereto. The at least one second elevated far-end channel 448 is disposed substantially parallel and sequentially next to the first elevated far-end channel 440. The first elevated near-end channel 420 is on a same plane (a first plane) as the first elevated far-end channel 440 and the at least one second near-end elevated channel 422 is on a same plane as the at least one second far-end elevated channel 448 (a second plane). The elevation of the first plane is different from that of the second plane. The number of the at least one second elevated near-end channels 422 and the at least one second elevated far-end channels 448 is the same.

According to an exemplary embodiment, the continuity plate 460 comprises a continuity plate outer surface 469, a continuity plate attachment surface 450, a first continuity plate end 462, and a second continuity plate end 468. The continuity plate attachment surface 450 comprises a near-end continuity groove 451 having a first elevated near-end continuity groove 453 and a second elevated near-end continuity groove 452, a far-end continuity groove 458 having a first elevated far-end continuity groove 456 and a second elevated far-end continuity groove 457. In some embodiments, the continuity plate attachment surface 450 further comprises at least one second elevated continuity groove 464. The first elevated near-end continuity groove 453 is disposed nearest to an edge of the first continuity plate end 462 and the second elevated near-end continuity groove 452 is disposed sequentially next to the first elevated near-end continuity groove 453 and is in communication therewith. The first elevated far-end continuity groove 456 is disposed nearest to an edge of the second continuity plate end 468 and the second elevated far-end continuity groove 457 is disposed sequentially next to the first elevated far-end continuity groove 456 and is in communication therewith. In some embodiments, the at least one second elevated continuity groove 464 is disposed between the second elevated near-end continuity groove 452 and the second elevated far-end continuity groove 457. The first elevated near-end continuity groove 453 is on a same plane (a first plane) as the first elevated far-end continuity groove 456 and the second near-end elevated continuity groove 452 is on a same plane as the second far-end elevated continuity groove 457 (a second plane). The first elevated near-end continuity groove 453 corresponds and communicates with the disposition and dimensions of the first elevated near-end channel 420. The first elevated far-end continuity groove 456 corresponds and communicates with the disposition and dimensions of the first elevated far-end channel 440. The second near-end elevated continuity groove 452 corresponds and communicates with the disposition and dimensions of the at least one second elevated near-end channel 422. The second far-end elevated continuity groove 457 corresponds and communicates with the disposition and dimensions of the at least one second elevated far-end channel 448. In some embodiments, the at least one second elevated continuity groove 464 is on a same plane as the second near-end elevated continuity groove 452 and the second far-end elevated continuity groove 457 (a second plane). In some embodiments, the at least one second elevated continuity groove 464 corresponds and communicates with the disposition and dimensions of a second elevated near-end channel 422 and at least one second elevated far-end channel 448. The elevation of the first plane is different from that of the second plane. The number of the second elevated near-end continuity groove 452 and the second elevated far-end continuity groove 457, respectively, is the same. In some embodiments, the number of the at least one second elevated continuity groove 464 is one, two, three, four or greater. As an example and not to be limiting, if the number of the second elevated near-end channel 422 and the second elevated far-end channel 448 is three, respectively, then two second elevated continuity grooves 464 would correspond and communicate with the disposition and dimensions of a second and third elevated near-end channel 422 and a second and third elevated far-end channel 448, respectively.

According to an exemplary embodiment, the second continuity plate 480 comprises a second continuity plate outer surface 489, a second continuity plate attachment surface 470, a first second continuity plate end 482, and a second second continuity plate end 488. The second continuity plate attachment surface 470 comprises a first elevated near-end continuity groove 471, a first elevated far-end continuity groove 478, at least one second elevated continuity groove 475, and a third elevated continuity channel 476 communicating with the first elevated near-end continuity groove 471 and the first elevated far-end continuity groove 478.

The first elevated near-end continuity groove 471 is disposed nearest to an edge of the first second continuity plate end 482 and the first elevated far-end continuity groove 478 is disposed nearest to an edge of the second second continuity plate end 478. The at least one second elevated continuity groove 475 is disposed between the first elevated near-end continuity groove 471 and first elevated far-end continuity groove 478 and the third elevated continuity channel 476 is disposed between the first elevated near-end continuity groove 471 and first elevated far-end continuity groove 478 and is in communication therewith. The first elevated near-end continuity groove 471 is on a same plane (a first plane) as the first elevated far-end continuity groove 478. The at least one second elevated continuity/reservoir groove 475 and the third elevated continuity channel 476 are on planes that are different from that of the first elevated near-end continuity/reservoir groove 471 (a second plane and a third plane), respectively. The elevation of the first plane is between the elevation of the second plane and third plane. The number of the at least one second elevated continuity groove 475 is the same as the number of the second elevated near-end continuity groove 422 and the second elevated far-end continuity groove 448.

According to an exemplary embodiment, the number of the at least one second elevated near-end channel 422 is five, the at least one second elevated far-end channel 448 is five, the at least one second elevated continuity/reservoir groove 475 is five, and the at least one second elevated continuity groove 464 is four; however, the embodiments are not limited thereto.

According to an exemplary embodiment, the shape of the first elevated near-end channel 420, first elevated far-end channel 440, at least one second near-end elevated channel 422, and at least one second elevated far-end channel 448 are quadrilateral and the dimensions are not all the same. The width of the first elevated near-end channel 420 is larger than the width of the first elevated far-end channel 440 and the widths of the sequential at least one second near-end elevated channels 422 and sequential at least one second elevated far-end channels 448 alternate either from a larger width to a smaller width and back to a larger width channel or a smaller width to a larger width and then back to a smaller width channel, and so on. That is, in this exemplary embodiment the second near-end elevated channels 422 and second far-end elevated channels 448 alternate in sequence, and all second near-end elevated channels 422 have the same width, and all second far-end elevated channels 448 have the same width that is smaller than the width of the second near-end elevated channels 422. Generally, the dimensions of the smaller widths are the same and the dimensions of the larger widths are the same; however, the embodiments are not limited thereto.

According to an exemplary embodiment, the first elevated near-end channel 420 is disposed nearest to an edge of the first body end 410A and at an angle thereto and the at least one second near-end elevated channel 422 is disposed substantially parallel and sequentially next to the angled first elevated near-end channel 420 and the first elevated far-end channel 440 is disposed nearest to an edge of the second body end 4108 at an angle thereto and the at least one second elevated far-end channel 448 is disposed substantially parallel and sequentially next to the angled first elevated far-end channel 440. In the illustrated embodiment, the end of the first elevated near-end channel 420 furthest to the edge of the first body end 410A is the end where the first elevated near-end channel 420 communicates with the first elevated near-end continuity groove 453. The distance from the edge of the first body end 410A where the first elevated near-end channel 420 communicates with the first elevated near-end continuity groove 471 is less than the distance from the edge of the first body end 410A where the first elevated near-end channel 420 communicates with the first elevated near-end continuity groove 453. The distance from the edge of the second body end 4108 where the first elevated far-end channel 440 communicates with the second far-end elevated continuity groove 456 is less than the distance from the edge of the first body end 410A where the first elevated near-end channel 420 communicates with the second second continuity plate end 478. However, the embodiments are not limited thereto.

Those of ordinary skill in the relevant art may readily appreciate that the shapes, the dimensions, and disposition of the first elevated near-end channel 320, 420, first elevated far-end channel 340, 440, at least one second near-end elevated channel 322, 422 and at least one second elevated far-end channel 348, 448 may be non-quadrilateral and different, respectively, depending upon application, as long as the first elevated near-end channel 320, 420 is on a same plane (a first plane) as the first elevated far-end channel 340, 440 and the at least one second near-end elevated channel 322, 422 is on a same plane as the at least one second far-end elevated channel 340, 440 (a second plane), and the elevation of the first plane and second plane are different and the first elevated near-end continuity groove 353, 453 and first elevated near-end second continuity groove 371, 471 corresponds and communicates with the disposition and dimensions of the first elevated near-end channel 320, 420, the first elevated far-end continuity groove 356, 456 and first elevated far-end second continuity groove 378, 478 corresponds and communicates with the disposition and dimensions of the first elevated far-end channel 340, 440, the second near-end elevated continuity groove 352, 452 and a portion of the at least one second elevated second continuity groove 375, 475 corresponds and communicates with the disposition and dimensions of the at least one second elevated near-end channel 322, 422, and the second far-end elevated continuity groove 357, 457 and a portion of the at least one second elevated second continuity groove 375, 475 corresponds and communicates with the disposition and dimensions of the at least one second elevated far-end channel 348, 448.

In the herein described embodiments, and using the first embodiment figures as an example, pulse loop heat exchangers, under vacuum, having a working fluid therein, comprise a heat exchanger body 110, a first continuity plate 160, and a second continuity plate 180 are provided. The heat exchanger body 110 and first continuity plate 160 and second continuity plate 180 comprise a plurality of channels and grooves on different elevated plane levels, respectfully. The different elevated plane levels result in increased output pressure gain in downward working fluid flow portions of the grooves, boosting thermo-fluidic transport oscillation driving forces throughout the pulse loop heat exchanger 100. The second continuity plate 180 comprises a second continuity plate attachment surface 170 having a third elevated continuity channel 176. In addition to providing for fluid transport and boosting oscillation driving forces, the third elevated continuity channel 176 also provides an internal reservoir. The pulse loop heat exchanger 100 is formed by an aluminum extrusion and stamping process and comprises three main steps, a providing step, a closing and welding step, and an insertion, vacuuming and closing step. Consistency in the manufacturing method is assured via the simplified and effective aluminum extrusion and stamping process. Also, the relatively flat, straight lined welding portions of the first continuity plate 160 and second continuity plate 180 to the heat exchanger body 110 provide an effective method to close and seal the pulse loop heat exchanger 100, averting poor leak tightness and poor body strength thereabout; thus, decreasing the possibility of loss of working fluid and dry-out, without increasing the complexity of the manufacturing method.

The presently disclosed inventive concepts are not intended to be limited to the embodiments shown herein, but are to be accorded their full scope consistent with the principles underlying the disclosed concepts herein. Directions and references to an element, such as "up," "down,", "upper," "lower," "horizontal," "vertical," "left," "right," and the like, do not imply absolute relationships, positions, and/or orientations. Terms of an element, such as "first" and "second" are not literal, but, distinguishing terms. As used herein, terms "comprises" or "comprising" encompass the notions of "including" and "having" and specify the presence of elements, operations, and/or groups or combinations thereof and do not imply preclusion of the presence or addition of one or more other elements, operations and/or groups or combinations thereof. Sequence of operations do not imply absoluteness unless specifically so stated. Reference to an element in the singular, such as by use of the article "a" or "an", is not intended to mean "one and only one" unless specifically so stated, but rather "one or more". As used herein, "and/or" means "and" or "or", as well as "and" and "or." As used herein, ranges and subranges mean all ranges including whole and/or fractional values therein and language which defines or modifies ranges and subranges, such as "at least," "greater than," "less than," "no more than," and the like, mean subranges and/or an upper or lower limit. All structural and functional equivalents to the elements of the various embodiments described throughout the disclosure that are known or later come to be known to those of ordinary skill in the relevant art are intended to be encompassed by the features described and claimed herein. Moreover, nothing disclosed herein is intended to be dedicated to the public regardless of whether such disclosure may ultimately explicitly be recited in the claims. No element or concept disclosed herein or hereafter presented shall be construed under the provisions of 35 USC 112(f) unless the element or concept is expressly recited using the phrase "means for" or "step for".

In view of the many possible embodiments to which the disclosed principles can be applied, we reserve the right to claim any and all combinations of features and acts described herein, including the right to claim all that comes within the scope and spirit of the foregoing description, as well as the combinations recited, literally and equivalently, in the following claims and any claims presented anytime throughout prosecution of this application or any application claiming benefit of or priority from this application.

What is claimed is:

1. A pulse loop heat exchanger, comprising:

a continuity plate comprising an outer surface, an attachment surface, a first end and a second end; and a heat exchanger body comprising a near body end, a far body end, and a plurality of channels, wherein the plurality of channels comprise:

a first elevated near-end channel disposed nearest to an edge of the near body end on a first plane, a second elevated near-end channel disposed sequentially next to the first elevated near-end channel on a second plane, a first elevated far-end channel disposed nearest to an edge of the far body end on the first plane; and a second elevated far-end channel disposed sequentially next to the first elevated far-end channel on the second plane;

wherein the continuity plate attachment surface comprises a near-end continuity groove having a first elevated continuity groove in communication with a second elevated continuity groove, and a far end continuity groove having a first elevated continuity groove in communication with a second elevated continuity groove;

wherein the near end continuity groove first elevated continuity groove is in the first plane and the near end continuity groove second elevated continuity groove is in the second plane, and the far end continuity groove first elevated continuity groove is in the first plane and the far end continuity groove second elevated continuity groove is in the second plane.

2. The pulse loop heat exchanger of claim 1; wherein the continuity plate attachment surface further comprises at least one second elevated continuity groove disposed between the second elevated continuity groove of the near-end continuity groove and the second elevated continuity groove of the far-end continuity groove on the second plane.

3. The pulse loop heat exchanger of claim 1, further comprising a working fluid under vacuum.

4. The pulse loop heat exchanger of claim 3, wherein the working fluid is selected for a predetermined boiling temperature.

5. The pulse loop heat exchanger of claim 1, wherein the continuity plate attachment surface forms an air-tight seal with the heat exchanger body.

6. The pulse loop heat exchanger of claim 1, further comprising a plurality of second elevated near-end channels and a plurality of second elevated far-end channels; and wherein a number of second elevated near-end channels is the same as a number of second elevated far-end channels.

7. The pulse loop heat exchanger of claim 1, wherein the first elevated near-end channel is angled relative to an edge of the heat exchanger body such that an end of the first elevated near-end channel closest to the continuity plate is closer to the edge of the near body end than an opposite end.

8. The pulse loop heat exchanger of claim 1, wherein the second elevated near-end channel has a different width than the second elevated far-end channel.

9. A method of manufacturing a pulse loop heat exchanger, comprising the steps of:

providing a continuity plate;

providing a heat exchanger body;

the continuity plate, and the heat exchanger having the channels and grooves described in claim 1;

joining the continuity plate to the heat exchanger body in an air-tight manner;

inserting a working pipe into one of the continuity plate, and the heat exchanger body;

inserting working fluid into channels within the heat exchanger body;

vacuuming air out of the channels within the heat exchanger body;

closing the working pipe; and cutting the working pipe.

10. The method of claim 9, wherein the heat exchanger body comprises aluminum or aluminum-alloy.

11. The method of claim 9, wherein providing a heat exchanger body comprises forming the heat exchanger body by an extrusion process.

12. The method of claim 9, wherein the grooves have a cross-sectional shape selected from the group consisting of triangle, rectangle, trapezoid, and reentrant.

13. The method of claim 9, wherein the grooves are sized to wick the working fluid.

14. The method of claim 9, wherein the continuity plate is formed by stamping.

15. The method of claim 9, wherein the continuity plate comprises a material selected from the group consisting of aluminum and aluminum-alloy.

* * * * *